US006474073B1

(12) United States Patent
Uetsuji et al.

(10) Patent No.: US 6,474,073 B1
(45) Date of Patent: Nov. 5, 2002

(54) THERMOELECTRIC DEVICE AND THERMOELECTRIC MANIFOLD

(75) Inventors: Toshio Uetsuji, Hirakata (JP); Syouhei Inamori, Yasu-gun (JP); Osao Kido, Soraku-gun (JP); Kenichi Morishita, Nishinomiya (JP); Masatsugu Fujimoto, Sakia (JP)

(73) Assignee: Matsushita Refrigeration Company, Osaka (JP)

( * ) Notice: Subject to any disclaimer, the term of this patent is extended or adjusted under 35 U.S.C. 154(b) by 0 days.

(21) Appl. No.: 09/936,991

(22) PCT Filed: Mar. 17, 2000

(86) PCT No.: PCT/JP00/01633

§ 371 (c)(1),
(2), (4) Date: Mar. 19, 1999

(87) PCT Pub. No.: WO00/57114

PCT Pub. Date: Sep. 28, 2000

(30) Foreign Application Priority Data

Mar. 19, 1999 (JP) ..... 11-076937

(51) Int. Cl.[7] ..... F25B 21/02
(52) U.S. Cl. ..... 62/3.3; 62/3.2
(58) Field of Search ..... 62/3.2, 3.3, 3.7, 62/434; 136/203, 204

(56) References Cited

U.S. PATENT DOCUMENTS 3,291,647 A 12/1966 Schneider et al.
5,255,520 A * 10/1993 O'Geary ..... 62/3.2
5,515,683 A 5/1996 Kessler
5,584,183 A 12/1996 Wright et al.

FOREIGN PATENT DOCUMENTS

| | | |
|---|---|---|
| DE | 242488 | 1/1987 |
| JP | 39-7546 | 5/1964 |
| JP | 64-59877 | 3/1989 |
| JP | 1-118193 | 8/1989 |
| JP | 6-504361 | 5/1994 |
| JP | 8-236820 | 9/1996 |
| JP | 10-311290 | 11/1998 |
| WO | 50-152204 | 12/1975 |
| WO | 89/01594 | 2/1989 |
| WO | 92/13243 | 8/1992 |
| WO | 95/31688 | 11/1995 |

* cited by examiner

*Primary Examiner*—Chew-Wen Jiang
(74) *Attorney, Agent, or Firm*—Wenderoth, Lind & Ponack, L.L.P.

(57) ABSTRACT

In a thermoelectric device such as a thermoelectric manifold having a plurality of stages of thermoelectric modules, not only are distributions of heat at endothermic and exothermic surfaces equalized to increase the heat exchange efficiency and also to suppress thermal strains in the thermoelectric modules, but also heat transmission between the thermoelectric modules is facilitated even though bowing occurs. For this purpose, in the thermoelectric device utilizing the plural thermoelectric modules, a fluid serving as a heat transfer medium is intervened between the thermoelectric modules and is utilized to achieve a transmission of heat from the exothermic surface of the thermoelectric module on a cooling side to the endothermic surface of the thermoelectric module on a heating side.

23 Claims, 16 Drawing Sheets

THERMOELECTRIC DEVICE AND THERMOELECTRIC MANIFOLD

FIELD OF THE INVENTION

The present invention relates to. a thermoelectric device utilizing, a thermoelectric module utilizable in a refrigerating apparatus and, more particularly to a thermoelectric manifold capable of cooling or heating a thermal medium in a fluid circuit for the thermal medium by utilization of a thermoelectric effect.

BACKGROUND ART

In recent years, depletion of the ozone layer in contact with fluorinated hydrocarbon gas has come to be a global problem and immediate development of refrigerating apparatuses that do not use fluorinated hydrocarbons is desired. Also, with the standard refrigerating apparatus utilizing a compressor, noises generated from the compressor are offensive to the ears particularly where the environment in which it is used is quiet. As one of the refrigerating apparatuses that do not use fluorinated hydrocarbons the refrigerating apparatus utilizing a thermoelectric module has now come to be spotlighted.

The Peltier effect is generally well known as a phenomenon in which when a weak electric current flows across the interface between dissimilar metals heat is evolved and absorbed. The thermoelectric module utilizing this Peltier effect is of a design in which pluralities of P-type semiconductor elements and N-type semiconductor elements are arranged in a matrix pattern, having been connected in series with each other through electrodes and are sandwiched between heat transfer plates to render the resultant assembly to represent a generally flat configuration. In this thermoelectric module, when a direct current is applied in one direction to the semiconductor elements, the heat transfer plates are cooled and heated, respectively, by the Peltier effect. Accordingly, one of the heat transfer surfaces acts as an exothermic surface whereas the other of the heat transfer surfaces acts as an endothermic surface.

In the thermoelectric module, it is thought that heat is transported from the endothermic surface towards the exothermic surface by the effect of exchange of kinetic energies and heat energies of electrons flowing through the semiconductor elements. Accordingly, if it is assumed that no heat conduction take place between the heat transfer plates through the semiconductor elements, the difference in temperature between-the endothermic and exothermic surfaces of the single thermoelectric module can be increased by choosing the number of the semiconductor elements and the electric current density.

In reality, however, heat evolved in the heat transfer plate on a heating side transfers to the heat transfer plate on a cooling side as a result of a heat conduction through the semiconductor elements. Accordingly, if the temperature difference between the endothermic and exothermic surfaces of the single thermoelectric module becomes large, the heat capacity brought about upon cooling or heating by the Peltier effect and the heat capacity of the above described heat conduction are counterbalanced with each other and no continued application of an electric current would result in increase of the temperature difference.

Accordingly, in order. for the thermoelectric device having the thermoelectric module built therein to enable the endothermic surface to be cooled down to a desired temperature, the Japanese Laid-open Patent Publication No. 8-236820 discloses stacking of a plurality of thermoelectric module one above the other so that they can be cooled stepwise to thereby enable the endothermic surface on a cooling side to be cooled down to a desired temperature.

With the prior art thermoelectric module, since the pluralities of the P-type semiconductor elements and N-type semiconductor elements are arranged in a matrix pattern and heat transport takes place in each of the semiconductor elements by the Peltier effect, a center portion of the endothermic surface is lower in temperature than that at a peripheral edge portion thereof and, on the other hand, a center portion of the exothermic surface is higher in temperature than that at a peripheral edge portion thereof. If a gradient occurs in a pattern of distribution of temperature at the endothermic surface and also at the exothermic surface, the cooling efficiency exhibited by the endothermic surface as a whole tends to be lowered. In particular, in the thermoelectric refrigerating apparatus utilizing the multi-staged thermoelectric modules, the temperature gradient tends to become large.

Once the temperature gradient becomes large, not only is the heat exchange efficiency reduced, but the thermoelectric module is susceptible to bowing deformation. In such case, cracking may occur at the joint between the semiconductor elements and the electrodes. Also, where a pair of heat transfer plate are used for each of the thermoelectric modules and the heat transfer plates are joined together to allow the plural thermoelectric modules to be laminated, bowing of one or more thermoelectric modules will result in separation of the heat transfer plates from each other and no heat transmission would occur properly between the thermoelectric module.

DISCLOSURE OF THE INVENTION

The present invention has for its object to provide a thermoelectric device such as a thermoelectric manifold having a multi-stage of thermoelectric modules, wherein the heat exchange efficiency is increased by equalizing heat distribution in each of the endothermic and exothermic surfaces and thermal strains in the thermoelectric modules are suppressed so that even though bowing takes place the heat transmission can favorably take place between the thermoelectric modules.

In order to accomplish the above described object, the present invention is such that in the thermoelectric device provided with a plurality of thermoelectric modules, a fluid that serves as a heat transfer medium is intervened between the thermoelectric modules so that through this fluid heat transmission takes place from an exothermic surface of the thermoelectric module on a cooling side towards an endothermic surface of the thermoelectric module on a heating side. Thus, if the heat transmission is caused to occur indirectly between the thermoelectric modules through the fluid, even when thermal strains are induced in the thermoelectric modules, the heat transfer medium favorably contacts the endothermic and exothermic surfaces of the thermoelectric modules with the heat transmission taking place favorably between the thermoelectric modules. Also, heat distribution at the endothermic or exothermic surface of each of the thermoelectric modules held in contact with the fluid can be equalized to thereby increase the heat exchange efficiency and also to lessen the thermal stresses in the thermoelectric modules.

The thermoelectric device of the present invention includes a plurality of thermoelectric modules each having endothermic and exothermic surfaces, wherein when an electric current is supplied the exothermic surface is heated and the endothermic surface is cooled, the plural thermoelectric modules being juxtaposed to each other with the exothermic surface of one of the neighboring thermoelectric modules and the endothermic surface of the other of the neighboring thermoelectric modules being held in face-to-face relation with each other; and a cavity defining member for defining a heat transfer cavity between the neighboring thermoelectric modules.

In the present invention, the fluid that serves as the heat transfer medium is sealed within, or is allowed to flow through, the heat transfer cavity and, by so doing, heat transfer takes place from the exothermic surface of one of the neighboring thermoelectric modules to the endothermic surface of the other of the neighboring thermoelectric modules through this fluid. Accordingly, even-when one or some of the thermoelectric module is deformed to bow under the influence of the thermal strains, the heat transfer medium favorably contacts the exothermic and endothermic surfaces and the heat transfer from the exothermic surface of the thermoelectric module on the cooling side towards the endothermic surface of the thermoelectric module on the heating side takes place favorably, resulting in considerable contribution to increase of the overall efficiency. Also, by the intervention of the heat transfer medium, the heat distribution at the exothermic or endothermic surfaces of each of the thermoelectric module can be equalized, the efficiency of the thermoelectric effect of each of the thermoelectric module can be increased and the thermal strains can be suppressed as small as possible.

The thermoelectric device of the present invention may be provided with a stirring means for stirring the fluid within the heat transfer cavity. According to this, by stirring the fluid within the heat transfer cavity by means of the stirring means, the heat transfer between the thermoelectric modules through the fluid can further efficiently take place. The stirring means achieves the stirring by providing a bypass passage above and below the heat transfer cavity and then by circulating the fluid within the heat transfer cavity by means of a pump, or a stirring blade supported rotatably within the heat transfer cavity may be employed. Also, stirring of the fluid can also be achieved if a plurality of iron balls are movably sealed within the heat transfer cavity and are rotated externally from the outside of the cavity by the action of a magnet.

Where the stirring blade is used for the stirring means, the stirring blade has to be appropriately rotated to achieve stirring of the fluid. As a rotation drive means for the stirring blade, various structures such as an electric motor and a hydraulic motor can be contemplated, but such an arrangement may be employed in which, for example, while a rotor is provided on the stirring blade, a stator which forms an electric motor together with the rotor is provided n the cavity defining member on one side externally of an outer periphery of the stirring blade. According to this, since the rotor is provided on the stirring blade itself, the overall structure can be simplified and compactized and the thermoelectric device of the present invention can be easily installed within a narrow space.

Also, in order to realize a stabilized rotating operation of the stirring blade with a simplified structure, the stirring blade may be rotatably supported by a support shaft which is in turn supported by an oscillation preventing member held in abutment with an inner surface of the heat transfer cavity defining member. It is to be noted that such an oscillation preventing member may be of a flat shape and preferably of a type contacting at least three locations of the inner surface of the heat transfer cavity, and is preferably constructed from a generally cross-shaped flat plate.

In order that in the above described thermoelectric device provided with the multi-staged thermoelectric modules the temperature difference between the endothermic and exothermic surfaces of each of the thermoelectric module can be optimized and the thermoelectric efficiency can further be increased, the thermoelectric modules may have different powers. In other words, where each of the thermoelectric module comprises the Peltier element provided with the P-type and N-type semiconductors connected in series with each other, the number of the semiconductors forming the respective thermoelectric module may differ from one thermoelectric module to another so that the powers of those thermoelectric modules can be adjusted. Also, even where a number of the same thermoelectric modules are employed, application of the electric current of a density different for each of the thermoelectric module is effective to differentiate the thermoelectric powers of the thermoelectric modules during operation.

Furthermore, arrangement may be made in which of the juxtaposed thermoelectric modules the thermoelectric modules on one side adjacent a cooling end may be provided with the cavity defining member for defining a cooling cavity between the endothermic surfaces thereof, which cavity defining member may be provided with an fluid inlet and a fluid outlet. According to this, the fluid introduced from the fluid inlet in the cooling cavity defining member into the cooling cavity can be caused to contact the endothermic surfaces on the side adjacent the cooling end to cool efficiently and can subsequently be discharged through the fluid outlet. If the fluid outlet is coupled with a heat exchanger such as, for example, that of a refrigerator, a desired space can be efficiently cooled through the fluid. Also, since the thermoelectric modules are arranged in multiple stages, as compared with a single stage a low temperature can easily be obtained and a desired temperature can be obtained even though compact and low in noise.

Also, arrangement may be made in which of the juxtaposed thermoelectric modules the thermoelectric modules on one side adjacent a heating end may be provided with the cavity defining member for defining a heating cavity between the exothermic surfaces thereof, which cavity defining member may be provided with a fluid inlet and a fluid outlet. According to this, the fluid introduced from the fluid inlet in the heating cavity defining member into the heating cavity can be caused to contact the exothermic surfaces on the side adjacent the heating end to efficiently cause heat evolved by the thermoelectric modules to be dissipated to the fluid and can subsequently be discharged through the fluid outlet. If the fluid outlet and the fluid inlet are coupled with an external heat discharge piping, the fluid serving as the heated heat transfer medium can be efficiently cooled naturally for reuse and the temperature at the endothermic surfaces on the side adjacent the cooling end can further be reduced down to a lower temperature.

Also, arrangement may be made in which of the juxtaposed thermoelectric modules the thermoelectric modules on one side adjacent a heating end may be provided with the cavity defining member for defining a heating cavity between the exothermic surfaces thereof, which cavity defining member may be provided with a fluid inlet and a fluid outlet. According to this, the fluid introduced from the fluid inlet in the heating cavity defining member into the heating cavity can be caused to contact the exothermic surfaces on the side adjacent the heating end to efficiently cause heat evolved by the thermoelectric modules to be dissipated to the fluid and can subsequently be discharged through the fluid outlet. If the fluid outlet and the fluid inlet are coupled with an external heat discharge piping, the fluid serving as the heated heat transfer medium can be efficiently cooled naturally for reuse and the temperature at the endothermic surfaces on the side adjacent the cooling end can further be reduced down to a lower temperature.

The above described thermoelectric device can be employed in various applications and in various embodiments. By way of example, it can be used as a cooling device such as a refrigerator or a cooler. Also, it can be built in a manifold which provides a flow tube for the heat transfer medium on the cooling side and/or the heat transfer medium on the heating side in, for example, a refrigerator so that cooling or heating of the heat transfer medium can be performed within the flow tube.

The present invention can be realized as a thermoelectric manifold having the thermoelectric module built in the manifold. In such thermoelectric manifold of the present invention, there is provided a plurality of thermoelectric modules each having endothermic and exothermic surfaces in which when an electric current is supplied the exothermic surface is heated and the endothermic surface is cooled, the plural thermoelectric modules being juxtaposed within a manifold body with the exothermic surface of one of the neighboring thermoelectric modules facing the endothermic surface of the other of the neighboring thermoelectric modules, a cooling cavity being provided within the manifold body and between the endothermic surfaces on one side adjacent the cooling end while a heating cavity is provided between the exothermic surfaces on one side adjacent the heating end, a heat transfer cavity being provided between the neighboring thermoelectric modules.

In the thermoelectric manifold of the present invention, a fluid serving as a cooled heat transfer medium is supplied into the cooling cavity whereas a fluid serving as a heated heat transfer medium is supplied into the heating cavity, and a fluid serving as a heat conducting heat transfer medium is sealed within or supplied into the heat transfer cavity, and a direct current is supplied to the thermoelectric module in a predetermined direction. Thereupon, not only is the cooled heat transfer medium contacting the endothermic surfaces on the side adjacent the cooling end is cooled, but the heated heat transfer medium contacting the exothermic surfaces on the side adjacent the heating end is heated. Also, heat transfer between the thermoelectric modules is carried by the fluid within the heat transfer cavity. Since the heat transfer is carried out between the thermoelectric modules through the fluid, even when the thermoelectric modules are deformed to bow under the influence of thermal strains, there is no possibility that the efficiency of heat transmission between the thermoelectric modules will decrease considerably. Accordingly, movement of heat from the cooled heat transfer medium towards the heated heat transfer medium takes place efficiently and the cooled heat transfer medium can be cooled down to a desired low temperature.

In the above described thermoelectric manifold of the present invention, the cooling cavity, the heating cavity and the heat transfer cavity may have respective stirring members disposed therein for stirring the fluids within such cavities. According to this, by stirring the fluids within each of those cavities by means of the associated stirring member, the fluid within the cooling cavity can be efficiently cooled, a highly efficient heat transfer can take place within the heat transfer cavity, and the heat can be dissipated efficiently to the fluid within the heating cavity.

Although the stirring members can be driven by respective drive means, in order to simplify the structure, to reduce the number of component parts and to render the device to be compact, they are preferably associate with each other by the utilization of magnetism. In other words, it is possible to arrange the endothermic and exothermic surfaces of the thermoelectric modules so as to be parallel to each other, to cause the stirring members to be supported rotatably within the manifold body for rotation about respective axes perpendicular to any one of the endothermic and exothermic surfaces and then to provide a paramagnetic body on each of the stirring member so that those stirring member can be driven in association with each other. It is to be noted that the number of paramagnetic bodies provided on each of the stirring members is preferred to be sufficient to transmit a rotational force, but all of them need not be a paramagnetic body and soft magnetic bodies such as iron can be appropriately provided.

Where the paramagnetic bodies are provided as rotational force transmitting means for the stirring members, if a rotational drive means is provided for the stirring member within one of the cooling cavity, the heating cavity and the heat transfer cavity, all of the stirring members can be driven. Such a rotational drive means may be of a type provided, for example, with a rotor provided on the stirring member within the cooling cavity or the heating cavity, and a stator provided on the manifold body and constitute an electric motor in cooperation with the rotor.

Also, even if the stator for- driving the stirring member with the paramagnetic bodies provided on the stirring member used as the rotor is provided radially outwardly of the stirring member within at least one heat transfer cavity, the rotational drive means for the stirring members can be constituted. According to this, since the stirring member at an intermediate position is driven and the rotational force produced thereby is transmitted to the stirring members on the heating and cooling sides, respectively, a loss of the rotational force is small and a highly efficient rotation can be achieved.

Also, in order to realize a stable rotation of the stirring member within the heat transfer cavity with a simplified structure, the stirring member may be rotatably supported by a support shaft which is in turn supported by an oscillation preventing member positioned in the manifold body. It is to be noted that such oscillation preventing member may be of a flat shape and preferably of a type contacting at least three locations of the inner surface of the heat transfer cavity, and is preferably constructed from a generally cross-shaped flat plate.

Also, in order that in the thermoelectric manifold provided with the multi-staged thermoelectric modules the temperature difference between the endothermic and exothermic surfaces of each of the thermoelectric module can be optimized and the thermoelectric efficiency can further be increased, the thermoelectric modules may have different powers. In other words, where each of the thermoelectric module comprises the Peltier element provided with the P-type and N-type semiconductors connected in series with each other, the number of the semiconductors forming the respective thermoelectric module may differ from one thermoelectric module to another so that the powers of those thermoelectric modules can be adjusted.

BEST MODE FOR CARRYING OUT THE INVENTION

Figure 1:
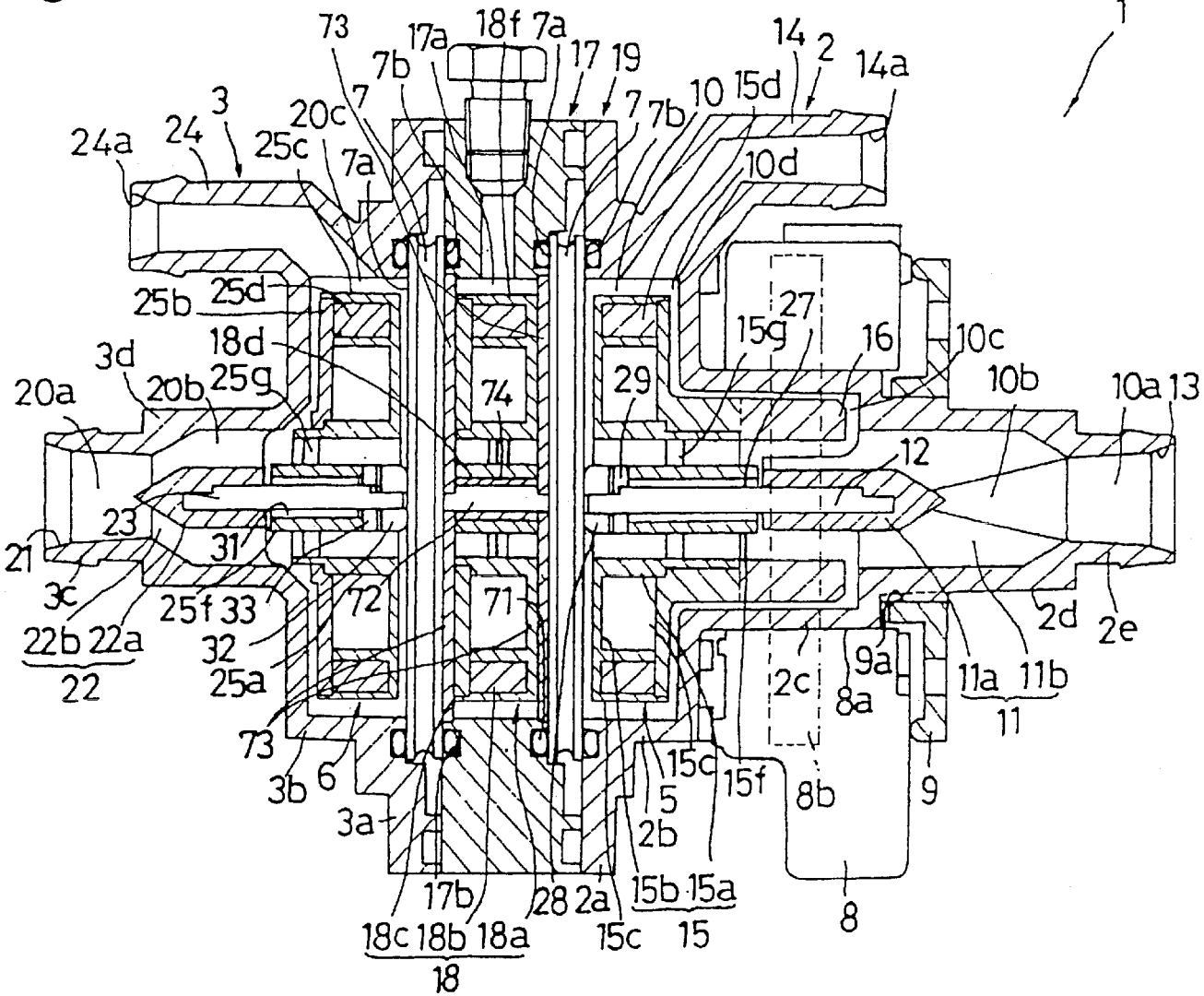
FIG. 1 is an overall longitudinal sectional view of a thermoelectric manifold according to a first embodiment of the present invention.

In describing some embodiments of the present invention, like parts are designated by like reference numerals and, therefore, only the difference, function and effect of those embodiments will be discussed.

(First Embodiment)

FIGS. 1 to 23 illustrates a thermoelectric manifold 1 forming a thermoelectric device according to a first embodiment of the present invention. This manifold 1 is generally divided into a heating side (right side viewed in FIG. 1) and a cooling side (left side viewed in FIG. 1). This manifold 1 includes a manifold body 19 made up of a heating side manifold segment 2, a cooling side manifold segment 3 and an intermediate manifold segment 17, a heating side stirring member 5, a cooling side stirring member 6, an intermediate stirring member 18, two thermoelectric modules 7, a motor casing member 8 enclosing a stator 8*b* and a fixing ring 9. Each of the thermoelectric modules 7 has endothermic and exothermic surfaces 7*a* and 7*b* substantially parallel to each other, and when a direct current is supplied in a predetermined direction to the thermoelectric modules 7; the endothermic surfaces 7*b* are heated and the exothermic, surfaces 7*a* are cooled.

To describe an important portion of the structure of the first embodiment, within the manifold body 19, a cooling cavity 20*c* is formed between its left end wall and the endothermic surface 7*a* of the cooling side thermoelectric module 7 (a left side surface of a left side thermoelectric module 7 as viewed in FIG. 1) and a heating cavity 10*d* is formed between its right end wall and the exothermic surface 7*b* of the heating side thermoelectric module 7 (a right side surface of a right side thermoelectric module 7 as viewed in FIG. 1). Also, a heat transfer cavity 17*a* is formed between the neighboring thermoelectric modules 7 (that is, between the opposed endothermic and exothermic surfaces 7*b* and 7*a* of the neighboring thermoelectric modules 7). In other words, the cooling cavity 20*c* is formed by a space within the cooling manifold segment 3, the heating cavity 10d is formed by a space within the heating manifold segment 2, and the heat transfer cavity 17*a* is formed by a space within the intermediate manifold segment 17 (a heat transfer cavity defining member).

The intermediate manifold segment 17 has a cylindrical inner space 17*a* defined therein so as to extend therethrough in an axial direction perpendicular to the thermoelectric modules 7 and the heat transfer cavity is formed by disposing the generally disc-shaped thermoelectric modules 7 at opposite open ends of the inner space 17*a*. It is to be noted that the intermediate manifold segment 17 is formed with annular O-ring mounting grooves 17*b* at respective positions adjacent outer peripheries of the opposite open ends of the inner space 17*a*, within which grooves 17*b* are mounted respective O-rings 71 in abutment with respective outer peripheral edges of the thermoelectric modules 7 to secure a sealability of the heat transfer cavity 17*a*. And, within this heat transfer cavity 17*a*, a heat transfer medium comprising water as a principle component is filed therein.

The exothermic surface 7*b* of the cooling side thermoelectric module 7 and the endothermic surface 7*a* of the heating side thermoelectric module 7 are held in face-to-face relation with each other and confront the heat transfer cavity 17*a*. Accordingly, heat from the exothermic surface 7*b* of the cooling side thermoelectric module 7 is first transmitted to the heat transfer medium within the heat transfer cavity 17*a* and then transmitted to the endothermic surface of the heating side thermoelectric module 7 through this heat transfer medium.

Figure 14:
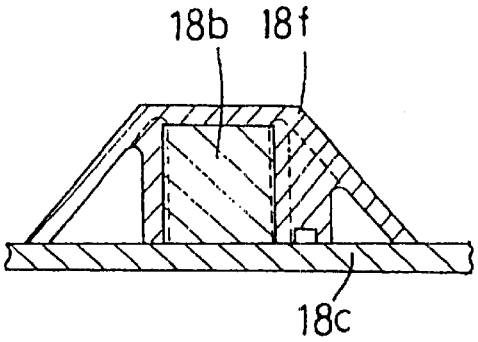
FIG. 14 is a transverse sectional view taken along the line E—E in FIG. 12.
Figure 12:
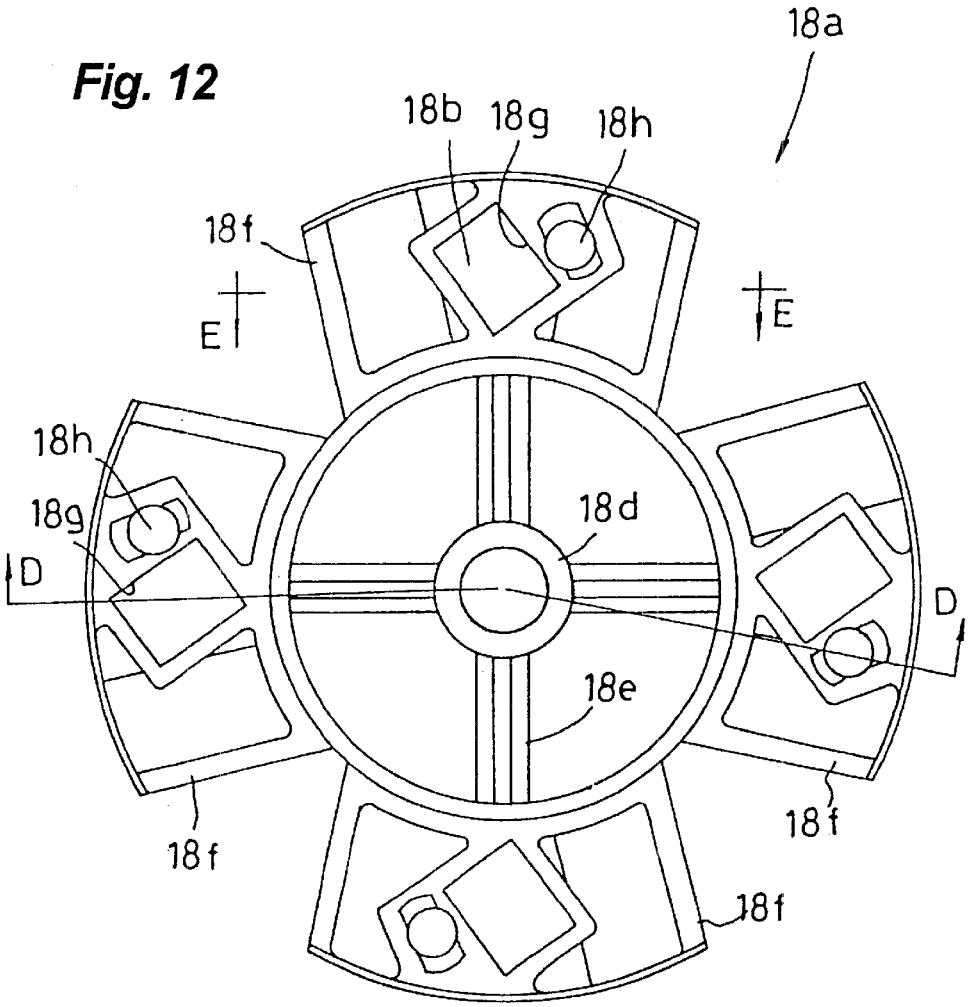
FIG. 12 is a rear view of the stirring blade of the intermediate stirring member in the first embodiment.
Figure 13:
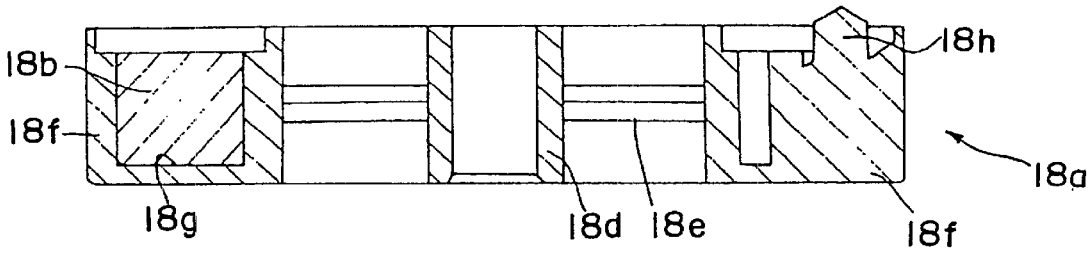
FIG. 13 is a transverse sectional view taken along the line D—D in FIG. 12.
Figure 15:
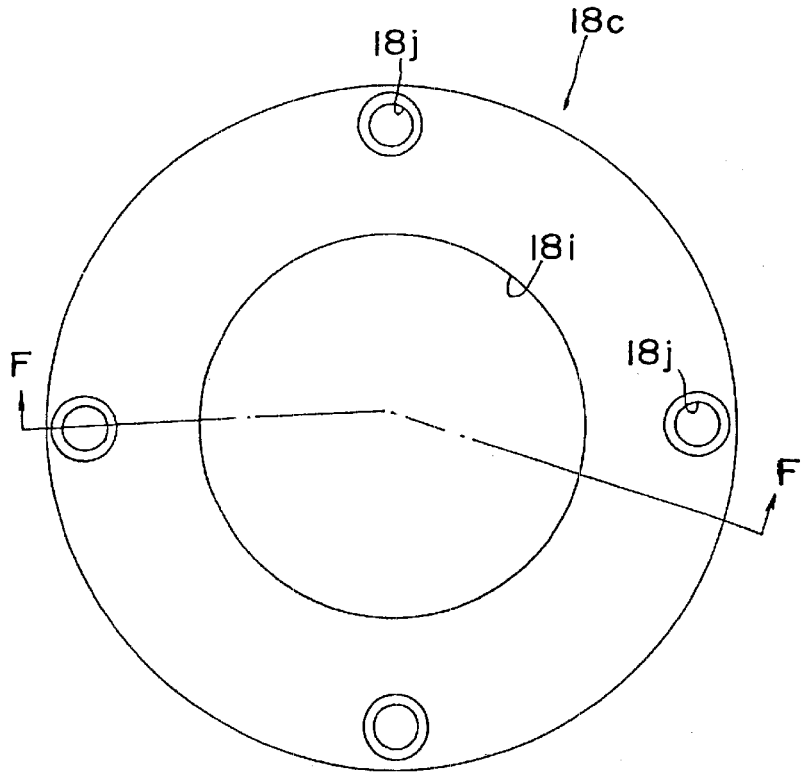
FIG. 15 is a front view of a fitting plate of the intermediate stirring member in the first embodiment.
Figure 16:
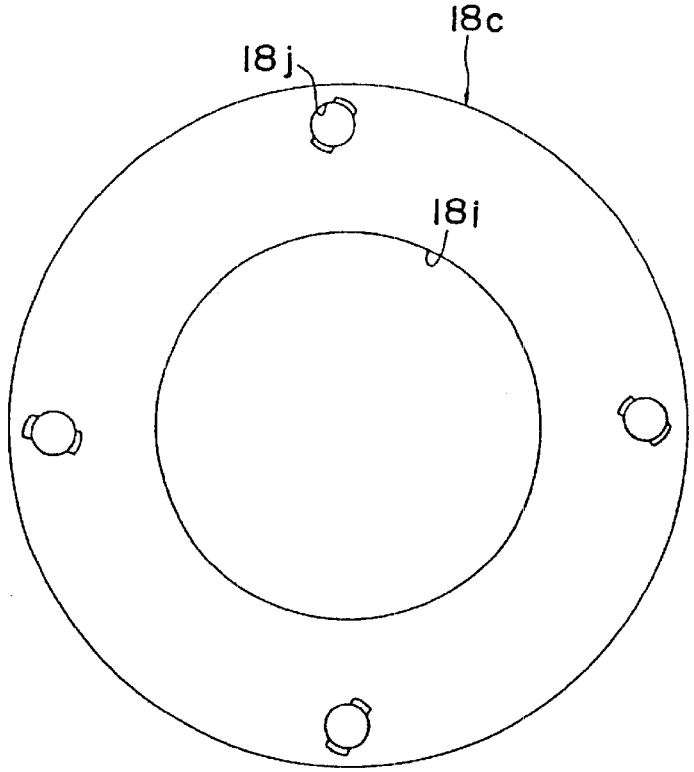
FIG. 16 is a rear view of the fitting plate of FIG. 15.
Figure 18:
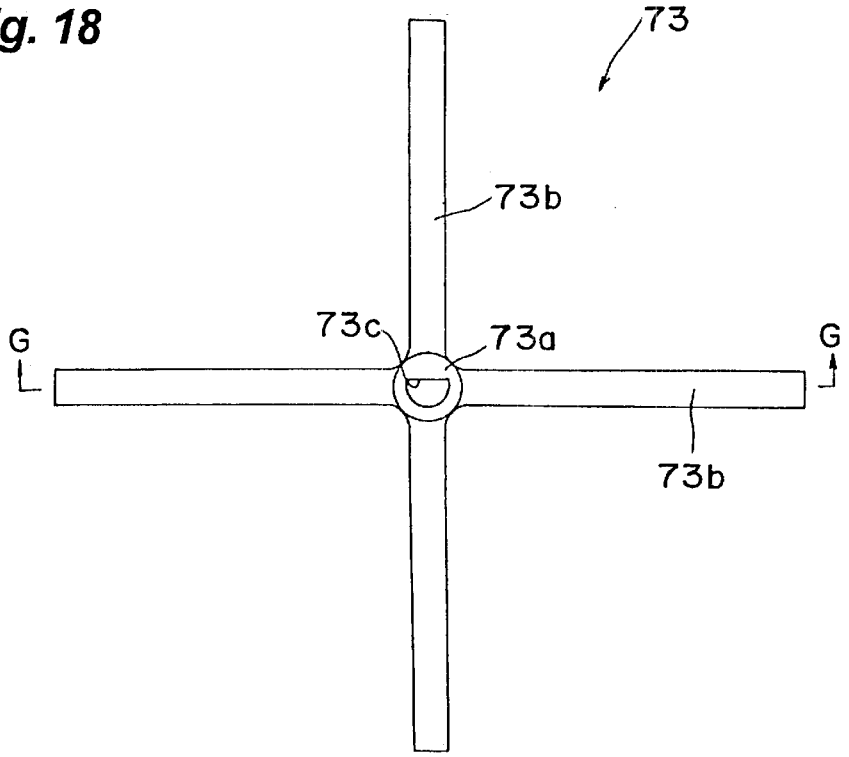
FIG. 18 is a front view of an oscillation preventing member in the first embodiment.
Figure 17:
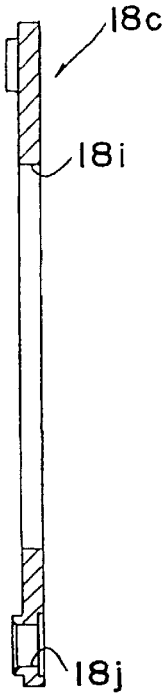
FIG. 17 is a transverse sectional view taken along the line F—F in FIG. 15.
Figure 19:
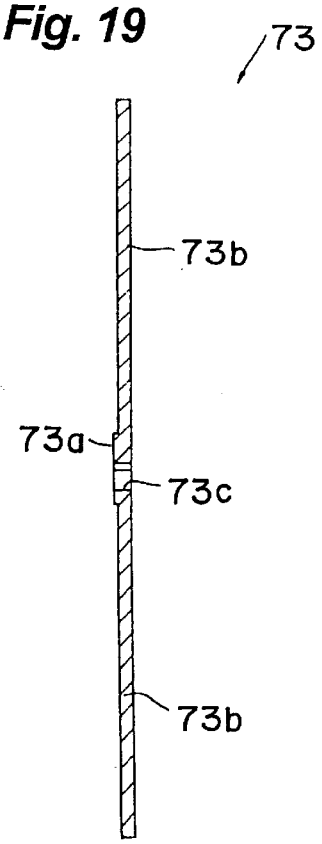
FIG. 19 is a transverse sectional view taken along the line G—G in FIG. 18.
Figure 20:
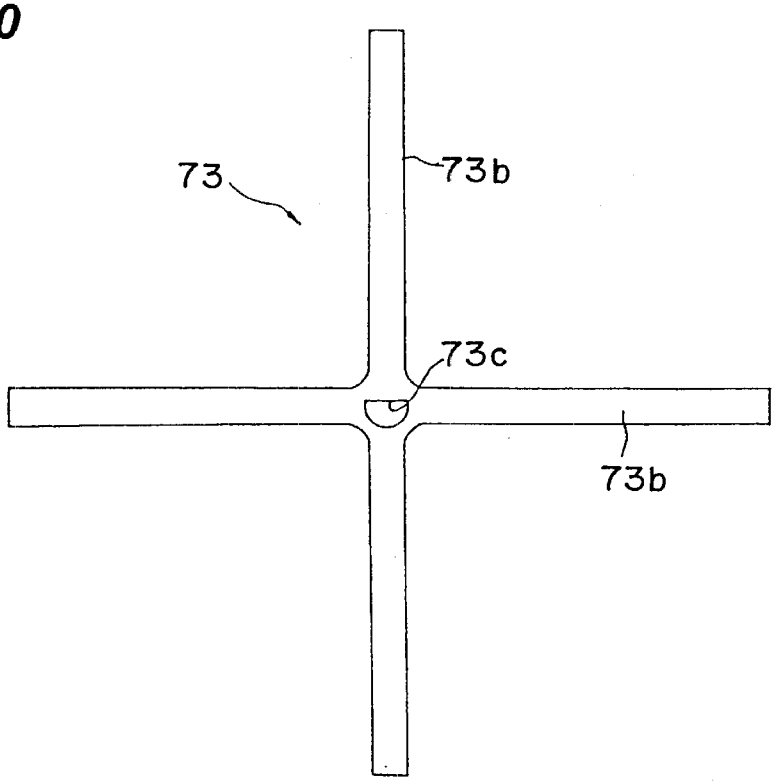
FIG. 20 is a rear view of the oscillation preventing member shown in FIG. 18.
Figure 21:
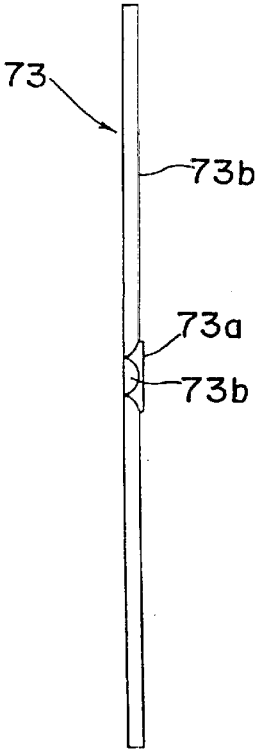
FIG. 21 is a side view of the oscillation preventing member shown in FIG. 18.

In order to optimize the heat transfer efficiency, a stirring member 18 for stirring the heat transfer medium is provided within the heat transfer cavity 17*a*. This stirring member 18 includes a stirring blade 18a as shown in FIGS. 11 to 14, a plurality of permanent magnets 18*b* (a paramagnetic body) embedded in a predetermined site in the stirring blade 18*a*, and a fitting plate 18*c* as shown in FIGS. 15 to 17 for carrying the permanent magnets 18*b*.

The stirring blade 18*a* includes a cylindrical boss portion 18*d* formed at an axial center thereof, and four vane members 18*f* formed integrally therewith through respective ribs 18*e* extending radially outwardly from the boss portion 18*d*. Each of the vane member 18*f* has a center portion having an increased wall thickness as shown in FIG. 14 and also has its opposite sides formed into respective inclined faces with respect to the direction of rotation thereof, representing a generally chevron shape as viewed in a direction perpendicular to the boss portion 18*d*. Each of the vane members 18*f* has a magnet fitting pocket 18*g* defined in a rear side thereof at an intermediate location for accommodating the corresponding permanent magnet 18*b* of a cubic shape. This magnet 18*b* has its polarity so arranged that the magnets 18*b* on one side adjacent one of the neighboring thermoelectric modules 7 represent a N-pole while that on one side adjacent the other of the neighboring thermoelectric modules 7 represent an S-pole. Each of the vane members 18*f* has a projection 18*h* formed therein so as to protrude outwardly from the rear surface thereof.

The fitting plate 15*c* is of a generally disc shape having its outer diameter substantially equal to that of the stirring blade 18*a*. Also, this plate 18*c* is formed with a hole 18*i* of a diameter somewhat greater than the inner diameter of the vane members 18*f* and also with a mounting hole 18*j* defined therein at a position corresponding to the projection 18*h* of the stirring blade 18*a*. This fitting plate 18*c* is so fitted and so fixed to the rear side of the stirring blade 18*a* that in a condition in which the magnets 18*b* are fitted to the stirring blade 18*a*, all of the projections 18*j* can be inserted into the respective mounting holes 18*j*.

The above described stirring member 18 is rotatably supported by a support shaft 72 positioned relative to the manifold body 19. This support shaft 72 is in turn supported by front and rear oscillation preventing members 73 mounted on inner surfaces of the intermediate manifold segment 17 so as to extend perpendicular to any one of the endothermic and exothermic surfaces 7*a* and 7*b* of the thermoelectric module 7. As shown in FIGS. 18 to 21, each of the oscillation preventing members 73 is in the form of a generally cross shaped plate member as viewed from front, having a boss portion 73*a* at a center thereof and four support bars 73*b* extending outwardly from the boss portion 73*a* in four directions. The boss portion 73*a* is formed with a support shaft fitting hole 73*c* of a generally semilunar shape. Respective free ends of the four support bars 73*b* of the oscillation preventing member 73 are held in abutment with a cylindrical inner wall surface of the intermediate manifold segment 17 so as to be positioned relative to the manifold body 19.

The support shaft 72 is inserted through and retained by the support shaft fitting holes 73*c* in the boss portions 73*a* of the oscillation preventing members 73. In other words, opposite ends of the support shaft 72 is cut to have a semilunar cross-section, one of which is inserted in the support shaft fitting hole 73*c* in the oscillation preventing member 73 disposed adjacent the cooling side thermoelectric module 7 whereas the other of them is inserted into the support shaft fitting hole 73*c* in the oscillation preventing member 73 disposed adjacent the heating side thermoelectric module 7, such that the support shaft 72 so supported by the oscillation preventing members 73 is positioned relative to the manifold body 19 (the intermediate manifold segment 17).

The stirring member 18 is rotatably supported by the support shaft 72 within the heat transfer cavity 17*a*. More specifically, the support shaft 72 has a cylindrical bushing 74 mounted thereon, on which the boss portion 18*d* of the stirring member 18 is mounted. It is to be noted that the boss portion 18*d* has an axial length substantially equal to the spacing between the oscillation preventing members 73 of the pair such that an axial position of the stirring member 18 can be positioned. Also, the vane members 18*f* of the stirring member 18 have an outer diameter somewhat smaller than the inner diameter of the heat transfer cavity. Preferably, selection of the ratio of a clearance, defined between the outer ends of the vane members 18*f* and the inner peripheral surface of the heat transfer cavity 17*a*, relative to the diameter of the stirring member 18 to about 0.03 (for example, in the case of 30 mm in diameter, the clearance will have about 1 mm) is preferred to ensure a smooth rotational operation of the stirring member 18 and also to optimization of stirring of the fluid by the stirring member 18.

As will be described later, a rotational force of the stirring member 5 within the heating side cavity 10d is transmitted through a rotational force transmitting means to the stirring member 18 to drive the latter. As this rotational force transmitting means, in the first embodiment of the present invention, magnets 18*b* and 15*d* fitted respectively to the stirring members 5 and 18 are shown. In other words, by the effect of a magnetic force acting between the magnets 15*d* fitted to the heating side stirring member 5 and the magnets 18*b* fitted to the intermediate stirring member 18, the stirring members 5 and 18 are drivingly associated with each other. It is to be noted that arrangement of poles of the magnets 15*d* and 8 are not specifically limited. By way of example, the N-poles and the S-poles of those magnets 15*d* and 18*b* are so arranged as to confront with each other so that a force of magnetic attraction may be utilized to drive them-in unison. Also, it is possible to drive them in unison by the utilization of a force of magnetic repulsion by arranging the same poles of the magnets 15*d* and 18*b* so as to confront with each other.

The thermoelectric manifold 1 in the first embodiment of the present invention is provided with the cooling side manifold segment 3 defining the cooling cavity in which the cooled heat transfer medium flows between it and the endothermic surface 7*a* of the cooling side thermoelectric module 7, and the heating side manifold segment 2 defining the heating cavity in which the heated heat transfer medium flows between it and the exothermic surface 7*b* of the heating side thermoelectric module 7. The heating side manifold segment 2 can be formed by the use of an injection molding technique using such a material as polypropylene resin or polyethylene resin.

Figure 3:
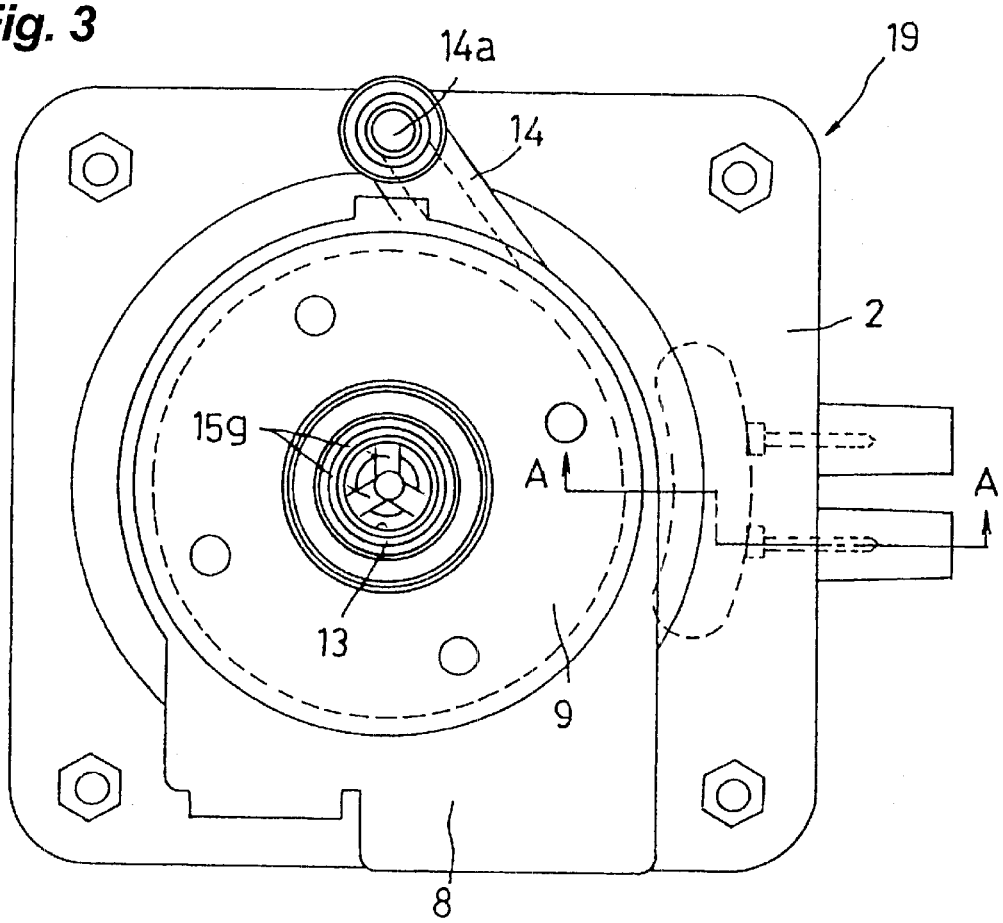
FIG. 3 is a right side view of the thermoelectric manifold in the first embodiment.
Figure 5:
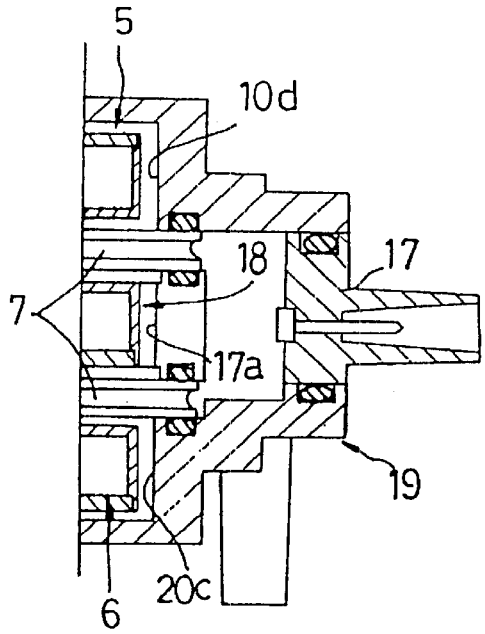
FIG. 5 is a transverse sectional view taken along the line A—A in FIG. 3.
Figure 4:
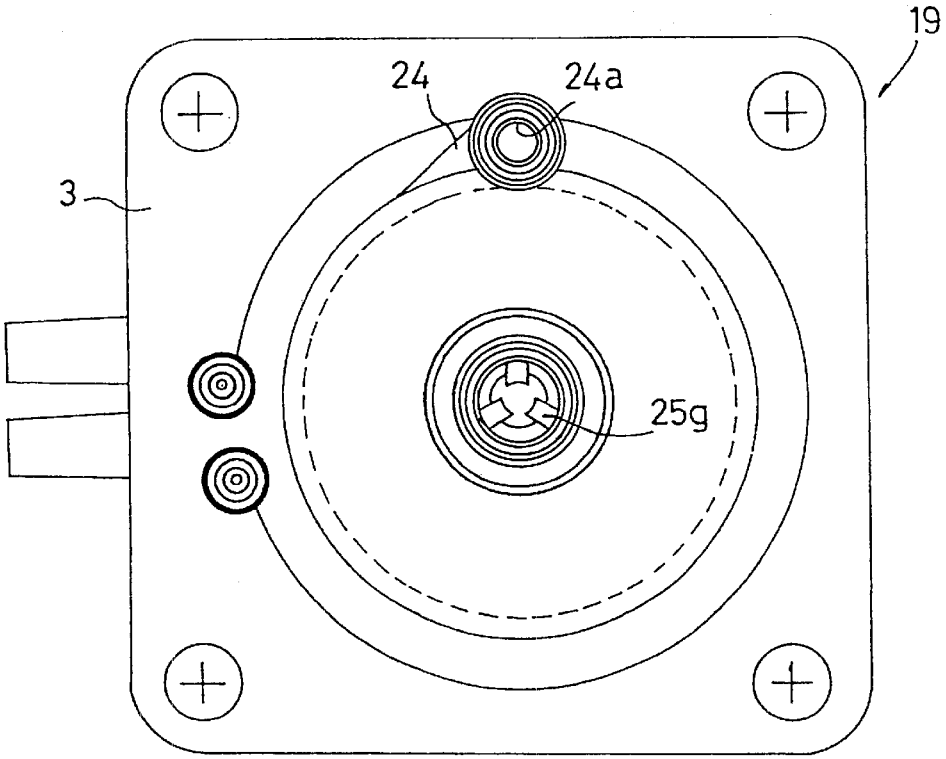
FIG. 4 is a left side view of the thermoelectric manifold in the first embodiment.
Figure 8:
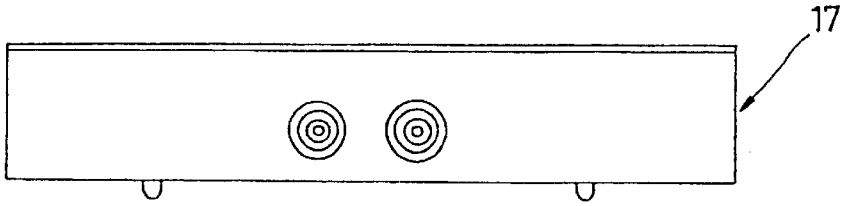
FIG. 8 is a rear view of the intermediate manifold segment of FIG. 6.
Figure 6:
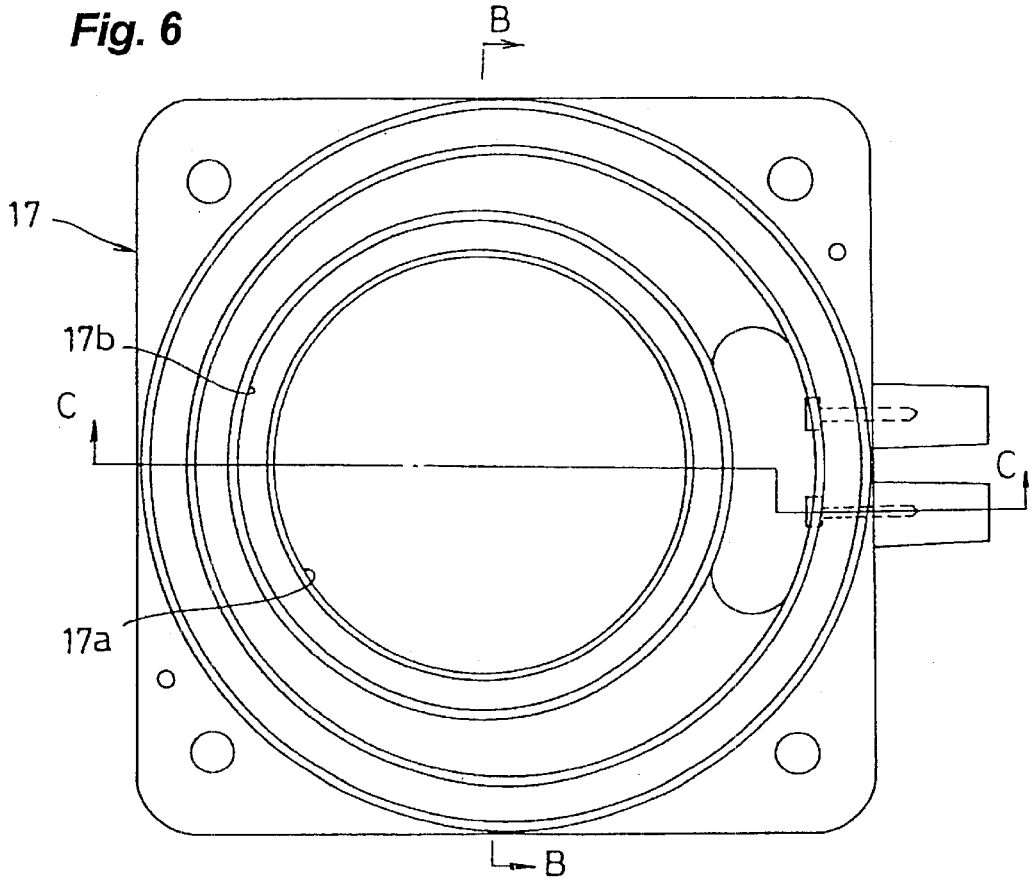
FIG. 6 is a right side view of an intermediate manifold segment in the first embodiment.
Figure 9:
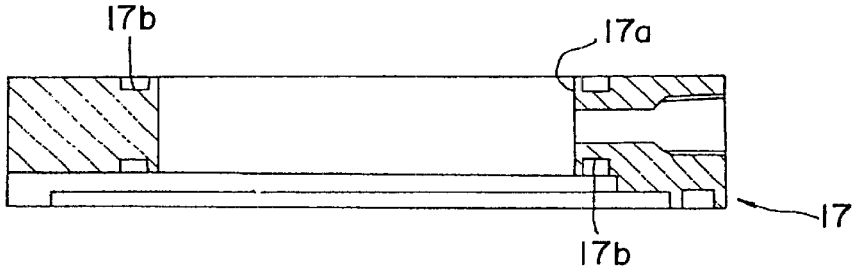
FIG. 9 is a transverse sectional view taken along the line B—B in FIG. 6.
Figure 7:
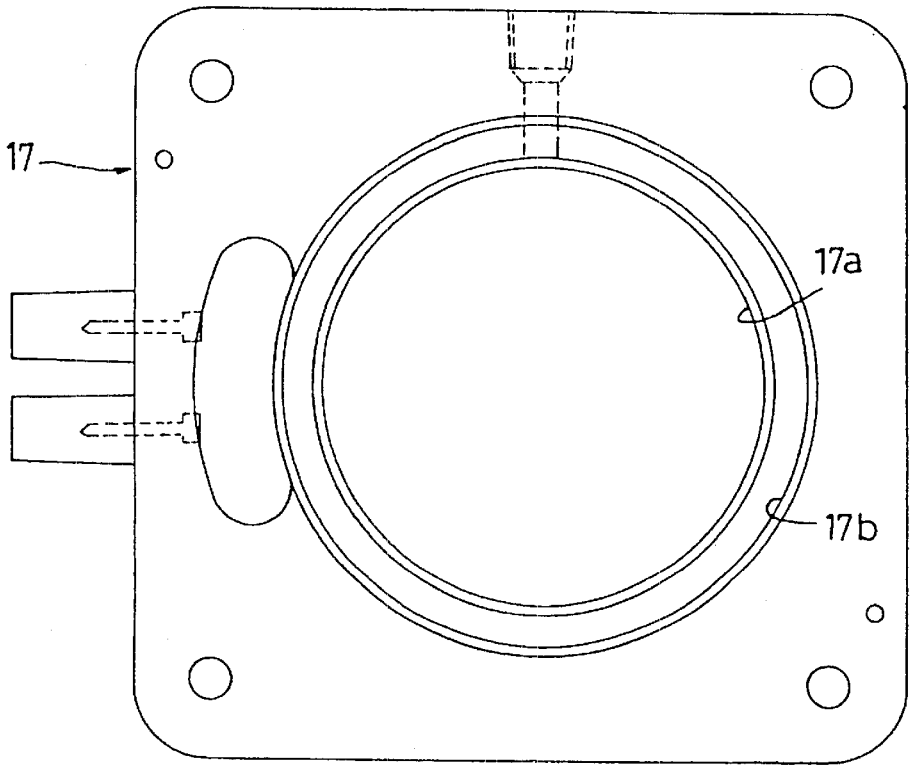
FIG. 7 is a left side view of the intermediate manifold segment of FIG. 6.

As shown in FIGS. 1 and 3, the heating. manifold segment 2 is of a structure including a disc-shaped flange portion 2*a* and boss portions 2*b* and 2*c* continued therefrom and continued to tubular portions 2*d* and 2*e*. In other words, the heating side manifold segment 2 has the flange portion 2A and the large diameter boss portion 2*b* continued therefrom. The large diameter boss portion 2*b* is in turn continued to the small diameter boss portion 2*c*. The small diameter boss portion 2*c* has one end narrowed to provide the large diameter tubular portion 2*d* having one end further narrowed to define the small diameter tubular portion 2*e*.

The interior of the heating side manifold segment 2 is a cavity 10 extending from the small diameter tubular portion 2*e* to the flange portion 2*a*. The cavity 10 within the heating side manifold segment 2 has a sectional representation which is round at any point over the entire length thereof. The cavity 10 has an inner diameter varying in dependence on the respective outer diameters of the boss portions 2*b* and 2*c* and the tubular portions 2*d* and 2*e* and an outer diameter stepped to increase from the small diameter tubular portion 2*e* to the flange portion 2*a*.

In other words, the cavity 10 within the heating side manifold segment 2 is divided into four regions including, in the order from the small diameter tubular portion 2*e*, a first cavity portion 10*a*, a second cavity portion 10*b*, a third cavity portion 10*c* and a fourth cavity portion 10*d*. The fourth cavity portion 10*d* opens at a site adjacent the flange portion 2*a* and the heating side thermoelectric module 7 is disposed at one end position adjacent this opening with the heating cavity formed between it and the thermoelectric module 7. In the illustrated embodiment, an opening 13 of the small diameter tubular portion 2*e* functions as a intake port for the fluid which will become the heat transfer medium, while the small diameter tubular portion 2*e* serves as a fluid intake tube.

Figures 2A, 2B, 2C, 2D:
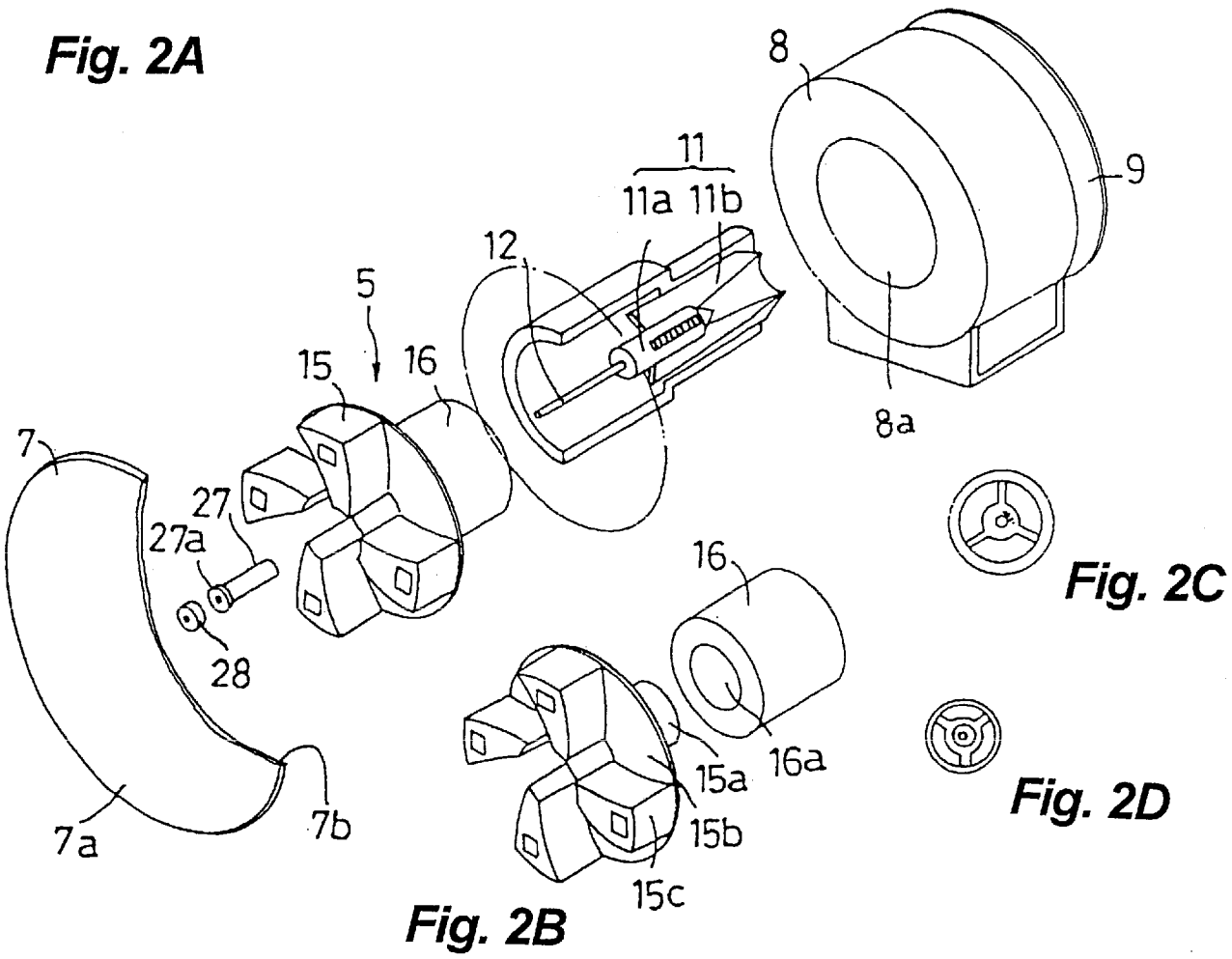
FIG. 2A is an exploded perspective view of a heating side of the thermoelectric manifold in the first embodiment.
FIG. 2B is an exploded perspective view of a heating side stirring member.
FIG. 2C is a sectional view of a small diameter boss portion of a heating side manifold segment.
FIG. 2D is a sectional view of a boss portion of a heating side stirring member.

Within the interior of the heating side manifold segment 2, there is provided a shaft fixture 11. This shaft fixture 11 includes as shown in FIGS. 1 and 2 a cylindrical shaft support 11*a*. The shaft support 11*a* is supported coaxially within the cavity 10 by means of ribs 11*b*. More specifically, within the interior of the large diameter tubular ortion 2*d*, that is, within the second cavity portion 10*b*, three ribs 11*b* are provided radially. These ribs 11*b* are integrally connected at one end with a side face of the shaft support 11*a* to thereby support the shaft support 11*a* coaxially within the second cavity portion 10*b*. An axial position of the shaft support 11*a* is where it straddle between the second and third cavity portions 10*b* and 10*c*. The shaft support 11*a* of the shaft fixture 11 is integrally connected with a shaft 12 made of stainless steel or the like. Accordingly, the shaft 12 is coaxially fixedly supported within the cavity 10.

The large diameter boss portion 2*b* is provided with a pipe-shaped fluid discharge tube 14 communicated outwardly from inside the heating cavity 10*d* (fourth cavity portion). This fluid discharge tube 14 has an outer open end serving as a fluid discharge port 14*a*.

Figure 22:
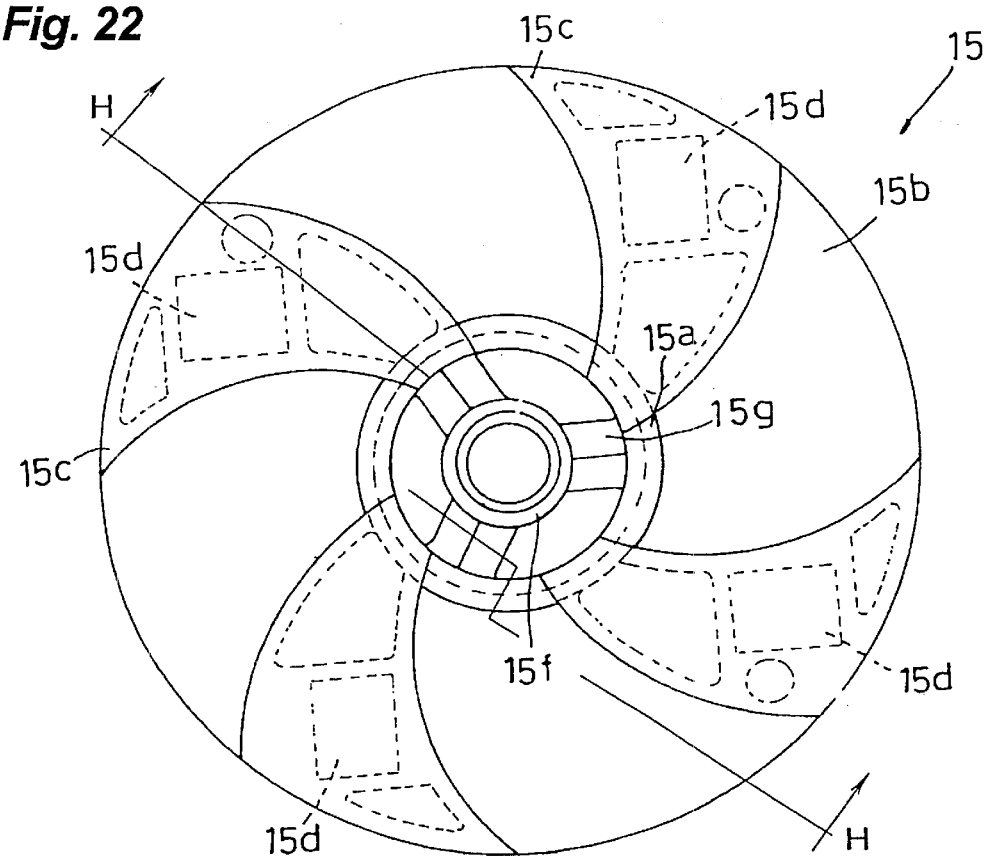
FIG. 22 is a front view of a heating side stirring member (a cooling side stirring member) in the first embodiment.

The heating side stirring member 5 is of a type in which the stirring blade 15 and the rotor 16 of the motor are integrated together. In other words, the stirring blade 15 of the heating side stirring member 5 is formed by injection molding of a synthetic resin and has a boss portion 15*a* and a disc portion 15*b*, four vane members 15*c* being provided on one of opposite surfaces of the disc portion 15*b*. As shown in FIG. 22, each of the vane member 15*c* has a center portion narrowed as viewed from front and has a width progressively increasing towards an outer periphery thereof and is of a shape twisted in a clockwise direction. With this structure, the stirring member 5 in the illustrated embodiment functions as an impeller (blade wheel) of a centrifugal pump to suck the heating side heat transfer medium through the fluid intake port 13 and discharge the heat transfer medium through the fluid discharge port 14*a*.

It is to be noted that the shape of vanes of the heating side stirring member 5 may not be always limited to that in the illustrated embodiment and may be similar to a blade of a windmill, a propeller or a disc having plates secured thereto so as to extend upright relative thereto.

A cubic-shaped permanent magnet 15*d* (a paramagnetic body) is fitted in an interior of each of the vane members 15*b*.

Figure 23:
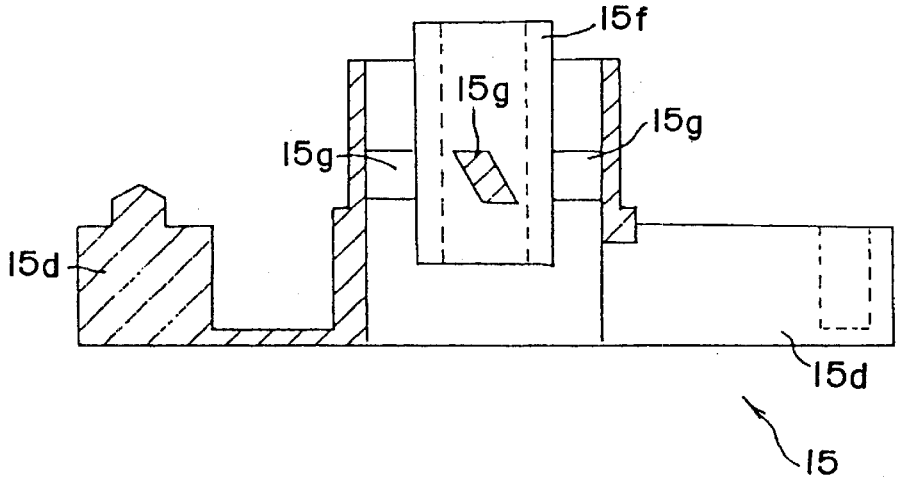
FIG. 23 is a transverse sectional view taken along the line H—H in FIG. 22.

On the other hand, the boss portion 15*a* is in the form of a hollow cylinder having an outer diameter which is ⅓ to ¼ of the disc portion 15*b*. As shown in FIGS. 22 and 23, a tubular bearing member 15*f* is provided at a center of the boss portion 15*a*. In other words, the bearing member 15*f* is retained at a position aligned with the center of the boss portion 15*a* by means of three ribs 15*g* provided inside the boss portion 15*d*.

In the illustrated embodiment, each of the ribs 15*g* is in the form of a plate having its surfaces inclined relative to an axial line. The heat transfer medium passes inside the boss portion 15*a* as will be described later. However, in the illustrated embodiment, since the ribs 15*g* are inclined relative to the axial line and act to entangle the fluid inwardly by rotation of the stirring member 5, a force of suction of the fluid is imparted from the fluid intake port 13 and the fluid can be smoothly introduced into the cavity 10 despite the presence of the ribs 15*g*.

The rotor 16 of the motor is specifically a cylindrical permanent magnet (a paramagnetic body). This rotor 16 has an outer diameter which is about 2/1 of the stirring blade 15. Also, the rotor 16 has a center portion formed with a hole 16*a* matching in diameter to the outer diameter of the previously described boss portion 15*d*. And, the rotor 16 is press-fitted into the boss portion 15*a* of the stirring blade 15 and is therefore integrated together therewith.

In the next place, the relation between the heating side manifold segment 2 and the heating side stirring member 5 will be discussed. The heating side stirring member 5 is disposed within and between the third and fourth cavity portions 10*c* and 10*d*. The shaft 12 of the heating side manifold segment 2 is inserted into the bearing member 15*f* of the heating side stirring member 5 through the bushing 27. Also, while the shaft 12 is inserted into the bearing member 15*f* of the heating side stirring member 5, a tip end of the shaft 12 has a stop member 28 mounted therein, which stop member is made of a high, heat conductive material such as aluminum. The stop member 28 is axially slidably mounted on the tip end of the shaft 12 and is held in abutment with the thermoelectric module 7. Also, a washer 29 is mounted around the shaft 12 and positioned between the stop member 28 and the bearing member 15*f*.

Accordingly, an end face of the bearing member 15*f* of the heating side stirring member 5 is held in abutment with the stop member 28 through the washer 29 and an axial force of the heating side stirring member. 5 is transmitted to the thermoelectric module 7 through the stop member 28 and is supported by such module 7. In the illustrated embodiment, the heating side stirring member 5 is, although rotatable, positioned axially immovable. In a condition in which the heating side stirring member 5 is mounted in the heating side manifold segment 2, the end face of the stop member 28 is positioned on the substantially same plane as a surface of the flange portion 2*a* of the heating side manifold segment 2.

In a condition in which the heating side manifold segment 2 and the heating side stirring member 5 are assembled together, the heat transfer medium intake port 13 of the heating side manifold 2 and a front surface side of the disc portion 15*b* of the heating side stirring member 5 are communicated with each other. In other words, the heat transfer medium intake port 13 is communicated with the first cavity portion 10*a* which is in turn communicated with an opening of the boss portion 15*a* of the heating side stirring member 5. The boss portion 15*a* is tubular and has its tip end portion opening towards the front surface of the disc portion 15*b* of the heating side stirring member 5. Accordingly, the heat transfer medium intake port 13 of the heating side manifold segment 2 and the front surface side of the disc portion 15*b* of the heating side stirring member 5 are communicated.

The structures of the cooling side manifold segment 3 and the cooling side stirring member 6 will now be described. The cooling side manifold segment 3 is in symmetrical relation with the previously described heating side manifold segment 2 and has a disc-shaped flange portion 3*a*. In the cooling side manifold segment 3, the boss portion 3*b* is one stage. A rear end of the boss portion 3*b* is continued to tubular portions 3*c* and 3*d*. The large diameter tubular portion 3*d* of the cooling side manifold segment 3 has an outer periphery which is a smooth cylindrical surface with no projection.

As is the case with the previously described heating side manifold segment 2, the interior of the cooling side manifold segment 3 is a cavity 20 extending from the small diameter tubular portion 3*e* to the flange portion 3*a*. The cavity 20 has an inner diameter is divided into three regions including, in the order from the small diameter tubular portion 3*e*, a first cavity portion. 20*a*, a second cavity portion 20*b* and a third cavity portion 20*c*. The third cavity portion 20*c* opens at a site adjacent the flange portion 3*a* and the cooling side thermoelectric module 7 is disposed at one end position adjacent this opening with the cooling cavity formed between it and the thermoelectric module 7. Also, an opening 21 of the small diameter tubular portion 3*e* functions as a intake port for the heat transfer medium.

Within the interior of the cooling side manifold segment 3, there is provided a shaft fixture 22 as is the case with the heating side manifold segment 2. This shaft fixture 22 includes a cylindrical shaft support 22*a*. The shaft support 22*a* is supported coaxially within the cavity 20 by means of ribs 22*b*. the shape, position and number of the ribs 22*b* are similar to those in the previously described heating side manifold segment 2 and three ribs 22*b* are provided radially within the second cavity portion 10*b* and are integrally connected at one end with a side face of the shaft support 22*a* to thereby support the shaft support 22*a* coaxially within the cavity 10. An axial position of the shaft support 22*a* is where it straddle between the second and third cavity portions 20*b* and 20*c*.

The shaft support 22*a* of the shaft fixture 22 is integrally connected with a shaft 23 made of stainless steel or the like, which is in turn coaxially fixedly supported within the cavity 20.

Even in the cooling side manifold segment 3, there is provided a pipe-shaped heat transfer medium discharge tube 24. This fluid discharge tube 24 has an outer open end serving as a fluid discharge port 24*a*.

The cooling side stirring member 6 is a stirring blade. In other words, the cooling side stirring member 6 has no rotor. The cooling side stirring member 6 has a shape substantially similar to the vane members 15 of the heating side stirring member 5 and has a boss portion 25*a* and a disc portion 25*b*, four vane members 25*c* being provided on one of opposite surfaces of the disc portion 25*b*. Each of the vane members 25*c* has, as is the case with the previously described vane member 15, a center portion narrowed and has a width progressively increasing towards an outer periphery thereof and is of a shape twisted in a clockwise direction. With this structure, the stirring member 5 in the illustrated embodiment functions as an impeller (blade wheel) of a centrifugal pump to suck the cooling side heat transfer medium through the fluid intake port 21 and discharge the heat transfer medium through the fluid discharge port 24*a*. Also, a cubic-shaped permanent magnet 25*d* is fitted in an interior of each of the vane members 15*b*.

Except for the overall length that is small, the shape and structure of the boss portion 25*a* are identical with those of the previously described heating side stirring member 5. In other words, the boss portion 25*a* is provided with ribs 25*g* positioned therein, and a tubular bearing member 25*f* is retained at a position aligned with the center of the boss portion 25*a* by means of these ribs 25*g*. Each of the ribs 25*g* is in the form of a plate having its surfaces inclined relative to an axial line to provide a force necessary to suck the fluid from the fluid intake port.

The relation between the cooling side manifold segment 3 and the cooling side stirring member 6 is substantially identical with that on the heating side, and the cooling side stirring member 6 is disposed within the third cavity portion 20*c* of the cooling side manifold segment 3.

Accordingly, an end face of the bearing member 25*f* of the cooling side stirring member 6 is held in abutment with a stop member 32 through a washer 33, and an axial force of the cooling side stirring member 6 is supported by the thermoelectric module 7 through the stop member 32. Accordingly, in the illustrated embodiment, the cooling side stirring member 6 is, although rotatable, positioned axially immovable. In a condition in which the cooling side stirring member 5 is mounted in the cooling side manifold segment 3, the end face of the fixing member 32 is positioned on the substantially same plane as a surface of the flange portion 3*a* of the cooling side manifold segment 6.

Also, in a condition in which the cooling side manifold segment 3 and the cooling side stirring member 6 are assembled together, the heat transfer medium intake port 21 of the cooling side manifold 3 and a front surface side of the disc portion of the cooling side stirring member 6 are communicated with each other.

The heating and cooling side thermoelectric modules 7 in the above described embodiment are of a disc-shaped configuration. Each of the thermoelectric modules 7 utilizes a known Peltier element made up of an alternating array of P-type and N-type semiconductors which are connected in series with each other through electrodes and sandwiched between heat conductive plates such as ceramic plates or aluminum plates.

In the illustrated embodiment, while the two thermoelectric modules 7 are employed, these thermoelectric modules 7 are so configured as to have different powers so that the efficiency of heat exchange through the heat transfer medium within the heat transfer cavity 17*a* can be increased. The power of the thermoelectric module 7 depends on the number of the semiconductors provided between the heat conductive plates, the density and the magnitude of a current density applied to the module 7. If the power is set by differing the number of the semiconductors forming the thermoelectric module 7, the thermoelectric module 7 can exhibit different powers while permitting the use of a common electric power for those modules 7. On the other hand, where the power is set by varying the current density, different thermoelectric powers can be exhibited while the thermoelectric modules 7 of the same structure are employed. In either case, when under the environment of use at normal temperatures the cooling side heat transfer medium is cooled down to 10° C. or lower, it is preferred that the thermoelectric power of the heating side thermoelectric module 7 is higher than that of the cooling side thermoelectric module 7.

The stator 8*b* forms an electric motor together with the rotor provided in the stirring member 5 and is generally employed in the form of an electromagnet. An outer diametric shape of the motor casing member 8 enclosing the stator 8*b* is substantially cylindrical and has a hole 8*a* defined at a center thereof. within this hole 8*a* is inserted the boss portion 2*c* of the manifold body 19, and the motor casing member 8 is fixed by the fixing ring 9.

The fixing ring 9 represents a generally disc shape having a screw hole 9*a* defined at a center thereof On the other hand, the boss portion 2*d* of the manifold body 19 has an outer periphery formed with a screw groove onto which the fixing ring 9 can be fastened.

Figure 24:
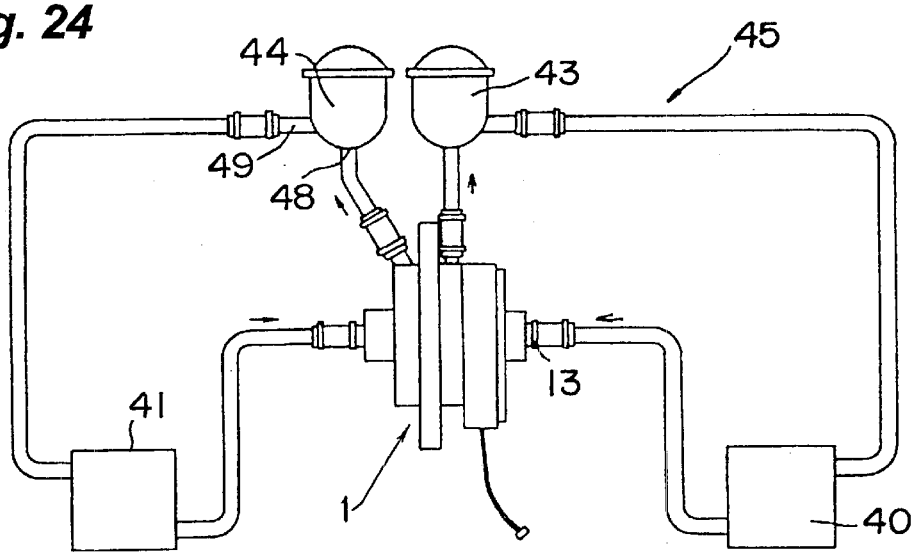
FIG. 24 is an overall piping diagram of a freezer utilizing the thermoelectric manifold in the first embodiment.

The function of the manifold 1 in the illustrated embodiment will now be described. The manifold 1 in the illustrated embodiment is used as a part of a freezing apparatus 45 including heat exchangers 40 and 41 and air vent chambers 43 and 44 as shown in FIG. 24.

The high and low temperature side air vent chambers 43 and 44 has a function of collecting unmixed gases by any reason from the piping system to thereby prevent it from being circulated in a piping circuit and also to facilitate a smooth circulation of the heat transfer medium even though the heat transfer liquid decreases by any reason. The high temperature side air vent chambers 43 and 44 are, briefly speaking, used to provide a space in which the gases are collected and has a portion of the largest capacity defined at a highest level of the piping circuit. A high temperature side of the manifold 1 is fluid coupled with a radiating condenser (heat exchanger) 40 and a high temperature air vent chamber 43.

More specifically, a discharge port of the radiating condenser (heat exchanger) 40 and the heat transfer medium intake port 13 of the manifold 1 are connected with each other. The heat transfer discharge port 14 of the manifold 1 and an intake port 48 of the high temperature side air vent chamber 46 are connected with each other. Also, a heat transfer medium discharge port 49 of the high temperature side air vent chamber 46 and an intake port of the radiating condenser (heat exchanger) 40 are connected with each other.

Thus, on a high temperature side of the manifold 1, a closed circuit including the manifold 1, the high temperature side air vent chamber 43 and the radiating condenser (heat exchanger) 40 is formed. A similar description equally applies to a cooling side piping system and a closed circuit including an endothermic evaporator (heat exchanger) 41 and a low temperature side air vent chamber 44 is formed.

Within the piping circuit, the heat transfer medium comprised of water as a principal component is circulated. It is to be noted that within the cooling side piping circuit, addition of an anti-freezing agent such as propylene glycol is preferred. While the heat transfer medium comprised of. water as a principal component ,is preferred because of its high specific heat, any other liquid medium can be. employed.

In the freezing apparatus to which the illustrated embodiment is applied, no extra pump is needed since the manifold 1 concurrently serves a function of pump for moving the heat transfer medium.

In this condition, an electric power is supplied to the thermoelectric modules 7 in the manifold 1 and also to the stator 8. Then, the temperature at the endothermic surface 7*a* of the cooling side thermoelectric module decreases and that at the exothermic surface 7*b* increases. Since the exothermic surface 7*b* of the cooling side thermoelectric module 7 and the endothermic surface 7*a* of the heating side thermoelectric module 7 are held in indirect contact with each other through the. heat transfer medium within the heat transfer cavity 17*a*, respective temperatures at. these surfaces are equalized. Since the endothermic surface 7*a* of the cooling side thermoelectric module 7 (cooling side endothermic surface) attains a temperature lower than that at the exothermic surface 7*b* thereof whereas the exothermic surface 7*b* of the heating side thermoelectric module 7 (heating side exothermic surface) attains a temperature higher than that at the endothermic surface 7*a*, viewing the plural staged thermoelectric modules 7 as a whole, the temperature difference between the cooling side endothermic surface 7*a* and the heating side exothermic surface 7*b* increases to a value larger than that attained when only one thermoelectric module is employed. Also, heat transmission between these two thermoelectric modules 7 is carried out through the fluid and, therefore, distribution of temperature at a heat transmitting surface intermediate between the plural thermoelectric modules can be equalized, accompanied by equalization of distribution of temperature at the endothermic and exothermic surfaces 7*a* and 7*b* on respective ends.

Also, upon energization of the stator 8*b* a magnetic force penetrates through the heating side manifold segment 2 to act on the rotor 16 disposed inside it. As a result thereof, a rotational force is generated in the rotor 16 inside the heating side manifold segment 2. Then, the rotor 16 and the heating side stirring member 5 integrated together therewith rotate. Consequently, the stirring blade 15 of the heating side stirring member 5 starts its rotation.

Here, in the manifold 1 of the illustrated embodiment, the magnets 15*d* and 25*d* are fitted to the stirring members 5, 6 and 8 and the stirring members 5, 6 and 18 are positioned on respective sides of the thermoelectric modules 7. As the magnets 15*d* of the heating side stirring member 5 and the magnets 18*b* of the intermediate stirring member 5 attract each other (or repel away from each other), the rotational force of the heating side stirring member 5 is transmitted to the intermediate stirring member 18 to cause the latter to rotate continuously. Also, as the magnets 18*b* of the intermediate stirring member 18 and the magnets 25*d* of the cooling side stirring member 6 attract each other (or repel away from each other), the rotational force of the intermediate stirring member 18 is transmitted to the cooling side stirring member 6 to cause the latter to rotate continuously.

Thus, by starting up the stator 8, the stirring members 5, 6 28 within the cavities rotate and the heat transfer medium within each of those cavities is stirred. In addition, the heating side and cooling side stirring members 5 and 6 functions as a vane wheel of a centrifugal pump to draw the heat transfer medium from the fluid intake ports 13 and 21, and urge the heat transfer medium toward the outer peripheries of those cavities by a centrifugal force so that the heat transfer medium can be discharged outwardly from the fluid discharge ports 14*a* and 24*a*. In this way, the manifold 1 incorporating the thermoelectric modules in the illustrated embodiment, although functioning as a pump, has a unique fluid circuit for the heat transfer medium inside it.

In other words, on the heating side of the thermoelectric manifold 1 according to the illustrated embodiment, the heat transfer medium enters through the heat transfer medium intake port 13 at the end of the heating side manifold segment 2. this heat transfer medium then flows within the first cavity portion 10*a* in the small diameter tubular portion 2*e*. Thereafter, the heat transfer medium passes between the ribs 11*b* within the second first cavity portion 10*b* in the large diameter tubular portion 2*d*. Further, the heat transfer medium flows through the boss portion 15*a* of the heating side stirring member 5 and then through the ribs 15*g* before it reaches the opening at the front surface of the disc portion 15*b* of the heating side stirring member 5.

A similar operation takes place on the cooling side as well, and the heat transfer medium entering through the heat transfer intake port 21 at the end of the cooling side manifold segment 3 flows through the first cavity portion 20*a*, then through the ribs 22*b* in the second cavity portion 20*b* and thereafter flows through the boss portion 25*a* of the cooling side stirring member 6 before it reaches at the center of the vane members 25 of the heating side stirring member 6.

In the manifold 1 incorporating the thermoelectric modules according to the illustrated embodiment, the heat transfer medium flows through the straight fluid circuit and then flows directly into the respective center portion of the vane members 15 and 25 of the heating side stirring members 5 and 6. Since the center portions of the vane members 15 and 25 are where a negative pressure is developed by the rotation, the manifold 1 incorporating the thermoelectric modules according to the illustrated embodiment can exhibit a high efficiency as a pump.

Figure 10:
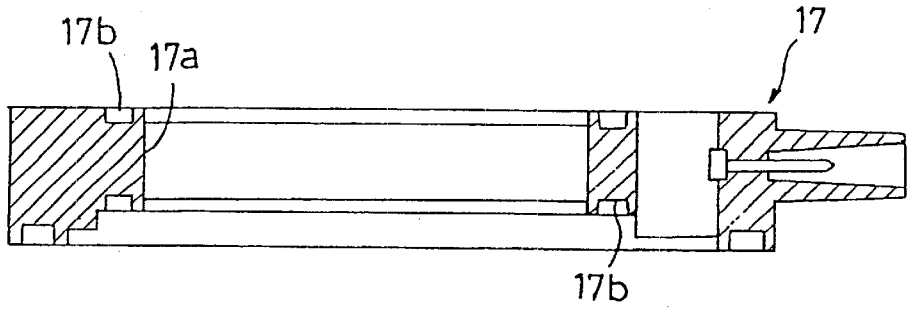
FIG. 10 is a transverse sectional view taken along the line C—C in FIG. 6.
Figure 11:
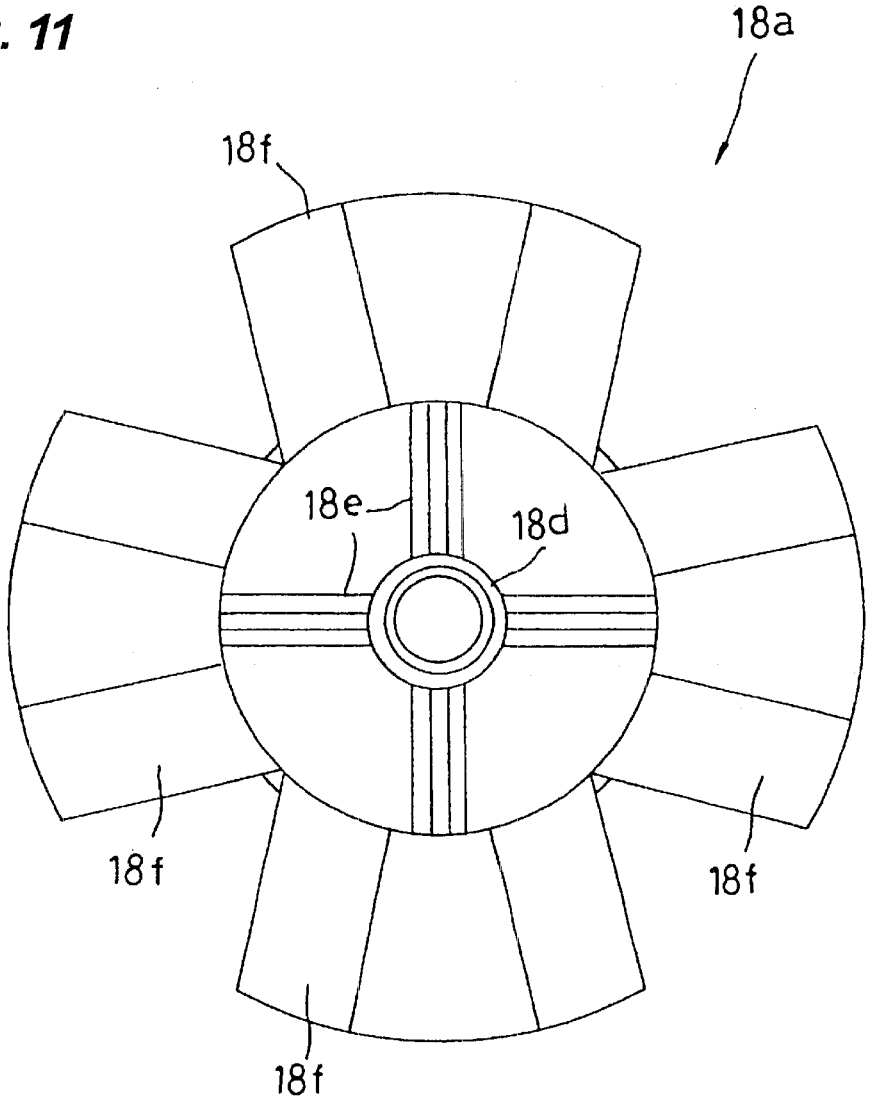
FIG. 11 is a front view of a stirring blade of an intermediate stirring member in the first embodiment.

Also, in the illustrated embodiment, the ribs 15*g* and 25*g* disposed respectively inside the boss portions 15*a* and 25*a* of the stirring members 5 and 6 are in the form of a plate and have their surfaces inclined relative to the axial line as shown in FIG. 10. For this reason, as the heat transfer medium passes through the boss portions 15*a* and 25*a*, a pumping force can be imparted to the heat transfer medium and, therefore, a higher efficiency can be expected.

The heat transfer medium entering the respective center portions of the vane members 15 and 25 are urged by the rotation of the vane members 15 and 25 and is then discharged from the heat transfer discharge ports 14 and 24. As the heat transfer medium is discharged, a fresh heat transfer medium is sucked through the heat transfer intake ports 13 and 21.

Since in the thermoelectric manifold 1 according to the illustrated embodiment the heat transfer medium is stirred, there is many opportunities for the heat transfer medium to contact the heat transfer surfaces 7*a* and 7*b*. Particularly in the illustrated embodiment, the heat transfer medium enters orthogonal to the heat transfer surfaces 7*a* and 7*b* of the thermoelectric module 7. For this reason, the heat transfer medium impinged at right angles to the thermoelectric module 7. Accordingly, the manifold 1 incorporating the thermoelectric modules according to the illustrated embodiment has a high efficiency of heat exchange between the heat transfer medium and the heat transfer surfaces 7*a* and 7*b*.

In addition, with the thermoelectric manifold 1 according to the illustrated embodiment, not only is the axially acting force supported by the stop members 28 and 32 fitted to the stationary shafts 12 and 23 of the stirring members 5 and 6, respectively, but also the stop members 28 and 32 are engaged with the substantially center portion of the heat transfer surface of the thermoelectric module 7 to enable the heat of the thermoelectric module 7 to be transmitted to the stop members 28 and 32. Since respective outer peripheral sides of those stop members 28 and 32 are defined as parts of the flow passage. for the heat transfer medium, the thermoelectric manifold of the illustrated embodiment can be expected to exhibit a high heat exchange efficiency.

It is to be noted that the stop members may be fixed on the stationary shafts 12 and 23, respectively, at a location slightly inwardly of respective surfaces of the associated flanges 2*a* and 3*a* so secure a gap between the stirring members 5 and 6 and the thermoelectric module 7 and the tip ends of the support shafts 12 and 23. According to this, by allowing the heat transfer medium to flow into the above described gap, the heat transfer medium is always present on the surface of the thermoelectric module and, therefore, a higher heat exchange efficiency can be expected.

(Second Embodiment)

Figure 25:
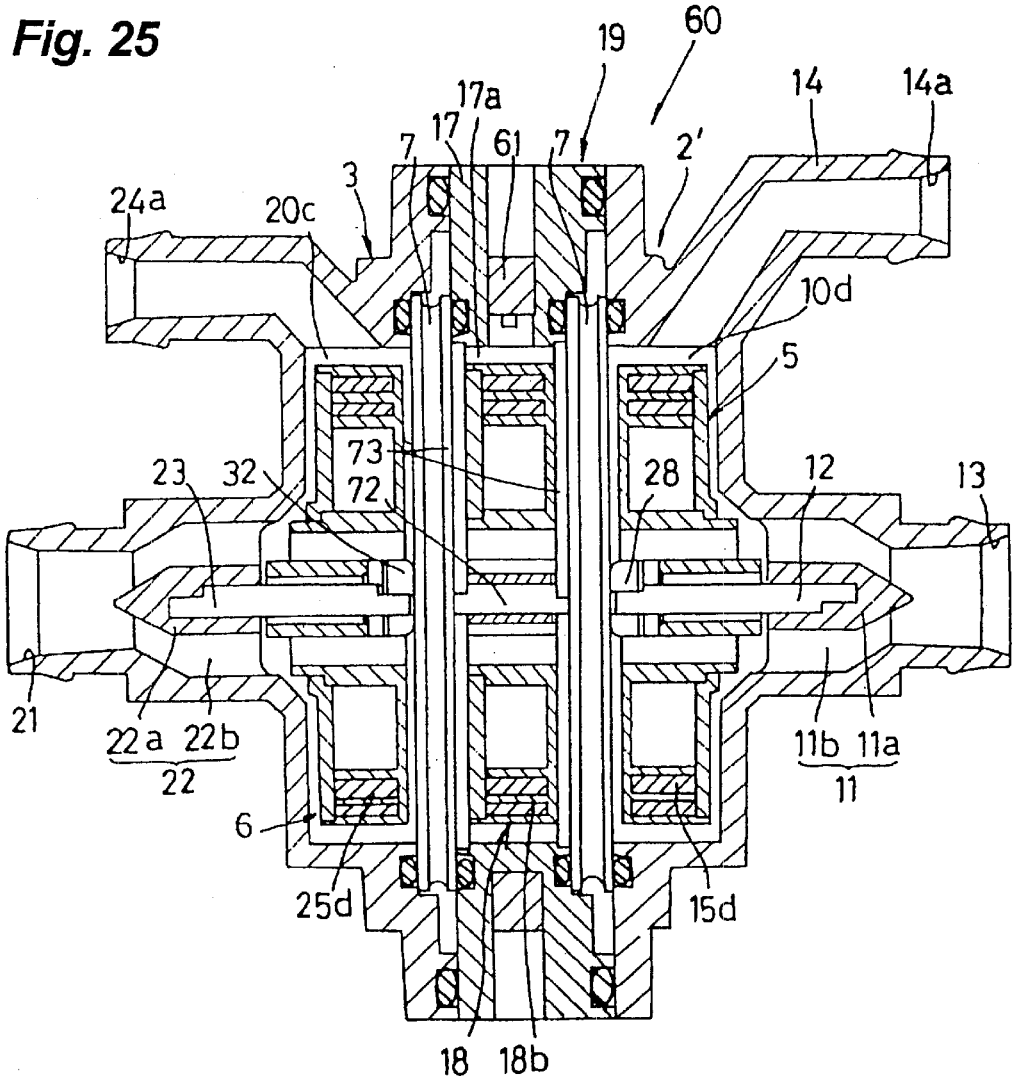
FIG. 25 is an overall longitudinal sectional view of the thermoelectric manifold according to a second embodiment of the present invention.
Figure 26:
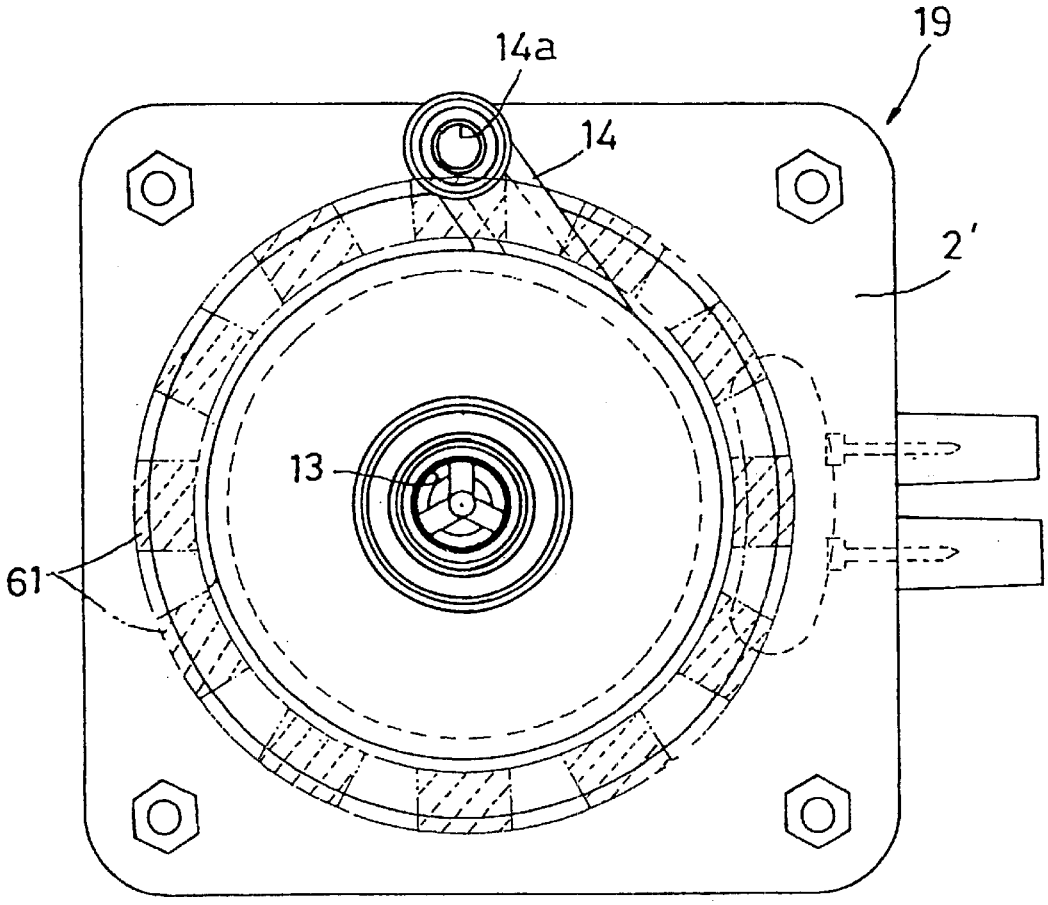
FIG. 26 is a right side view of the thermoelectric manifold shown in FIG. 25.

With reference to FIGS. 25 and 26, a second embodiment of the present invention will be described. The thermoelectric manifold forming the thermoelectric device according to this second embodiment is identified by 60. In this manifold 60, the stator 61 for driving the stirring members 5, 6 and 18 is disposed inside the intermediate manifold segment 17 and at a location adjacent an outer periphery of the intermediate stirring member 18. The magnets 18*b* fitted to the intermediate stirring member 18 serve as a rotor, and this rotor 18*b* and the stator 61 altogether define an electric motor. Accordingly, when a voltage is applied to. the. stator 61,, the intermediate stirring. member 18 is . driven first. The rotational force of this intermediate stirring member 18 is transmitted to the cooling side stirring member 6 and also to the heating side stirring member 5 by the action of magnetic forces of the magnets 18*b* 25*d* and 15*d*, thereby causing the stirring members 5 and 6 to be driven unison.

Also, the heating manifold segment 2' is of a structure symmetrical with the cooling manifold segment 3 in the first embodiment and no rotor is provided on the heating side stirring member 5.

According to the second embodiment, since the rotor 18*b* is provided on the intermediate stirring member 5 so that the stirring member 18 can be driven and the rotational force of the intermediate stirring member 18 is transmitted by the utilization of the magnetic force to the stirring members 5 and 6 on respective sides thereof in the axial direction, not only can all of the stirring members 5, 6 and 18 be driven efficiently to assuredly stir the fluid within each of the cavities while the structure can be simplified, the number of component parts is reduced, compactization is aimed at and, at the same time, a loss of power transmission is reduced, but also the stirring members are made to function as a pump securely.

(Third Embodiment)

Figure 27:
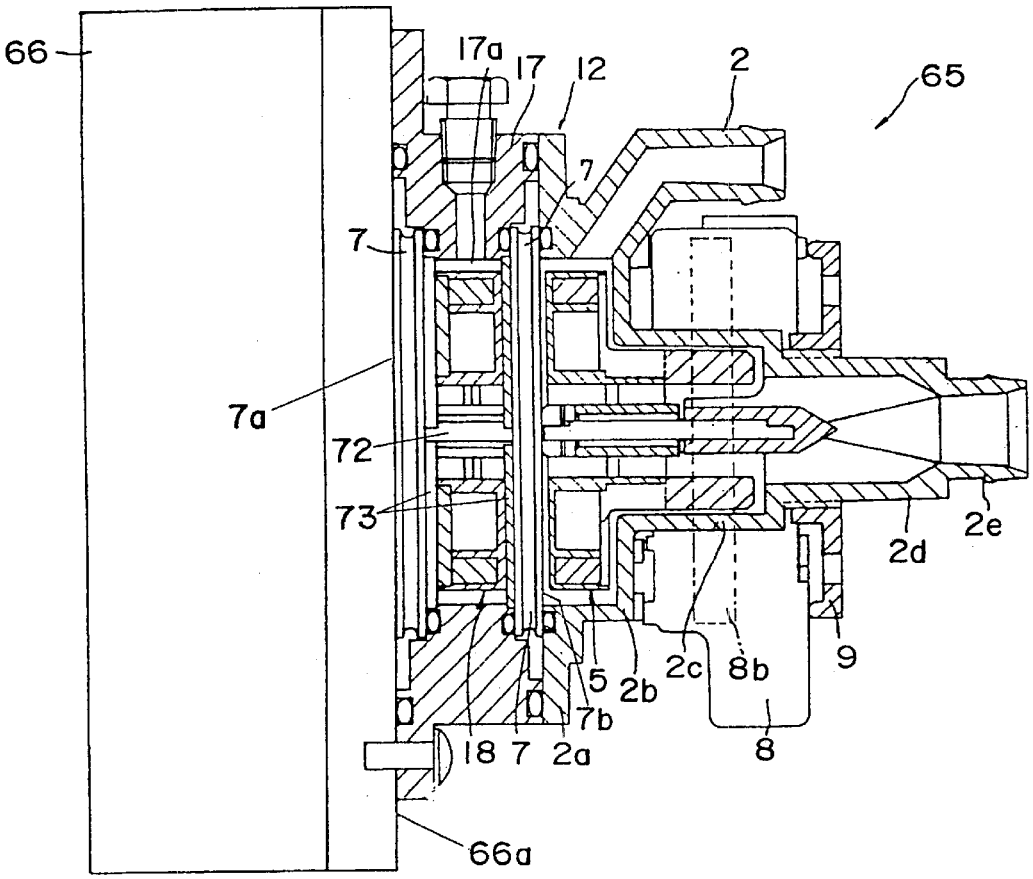
FIG. 27 is an overall longitudinal sectional view of a thermoelectric device according to a third embodiment of the present invention.
Figure 28:
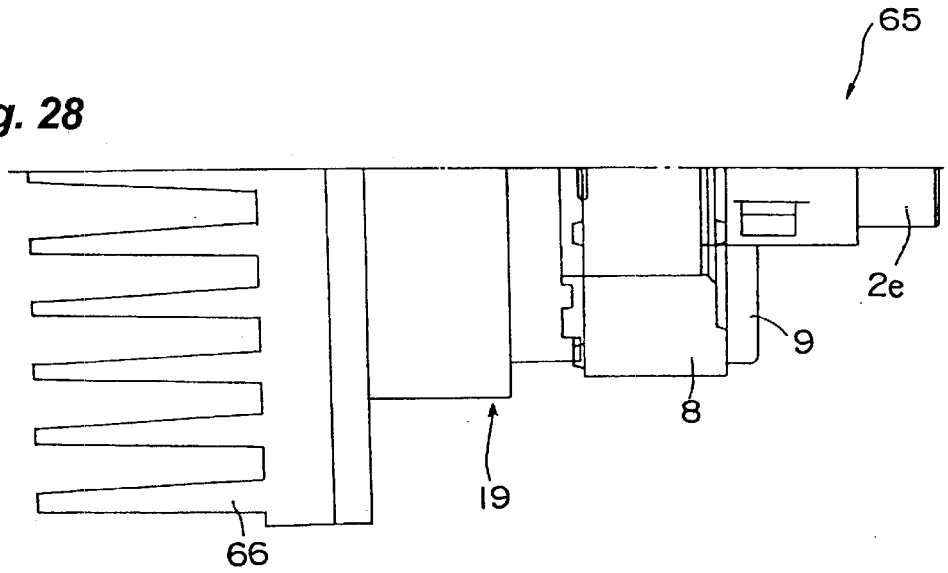
FIG. 28 is a plan view of the thermoelectric device shown in FIG. 27.

FIGS. 27 and 28 illustrates the thermoelectric device 65 according to a third embodiment of the present invention. In this thermoelectric device 65, only the heating side manifold is used and no manifold is used on the cooling side. The heating side manifold segment 2 has a structure totally identical with that in the first embodiment and this embodiment is a version in which the cooling side manifold segment 3 used in the previously described embodiments is replaced with a fin member 66. In other words, in the thermoelectric device 65 according to the third embodiment, the endothermic surface 7*a* of the cooling side thermoelectric module 7 is held in direct contact with a wall surface (heat conductive plate) 66*a* of the fin member 66. This manifold according to this embodiment is suited for use in a refrigerator having an interior space cooled by the fin member 66.

(Fourth Embodiment)

Figure 29:
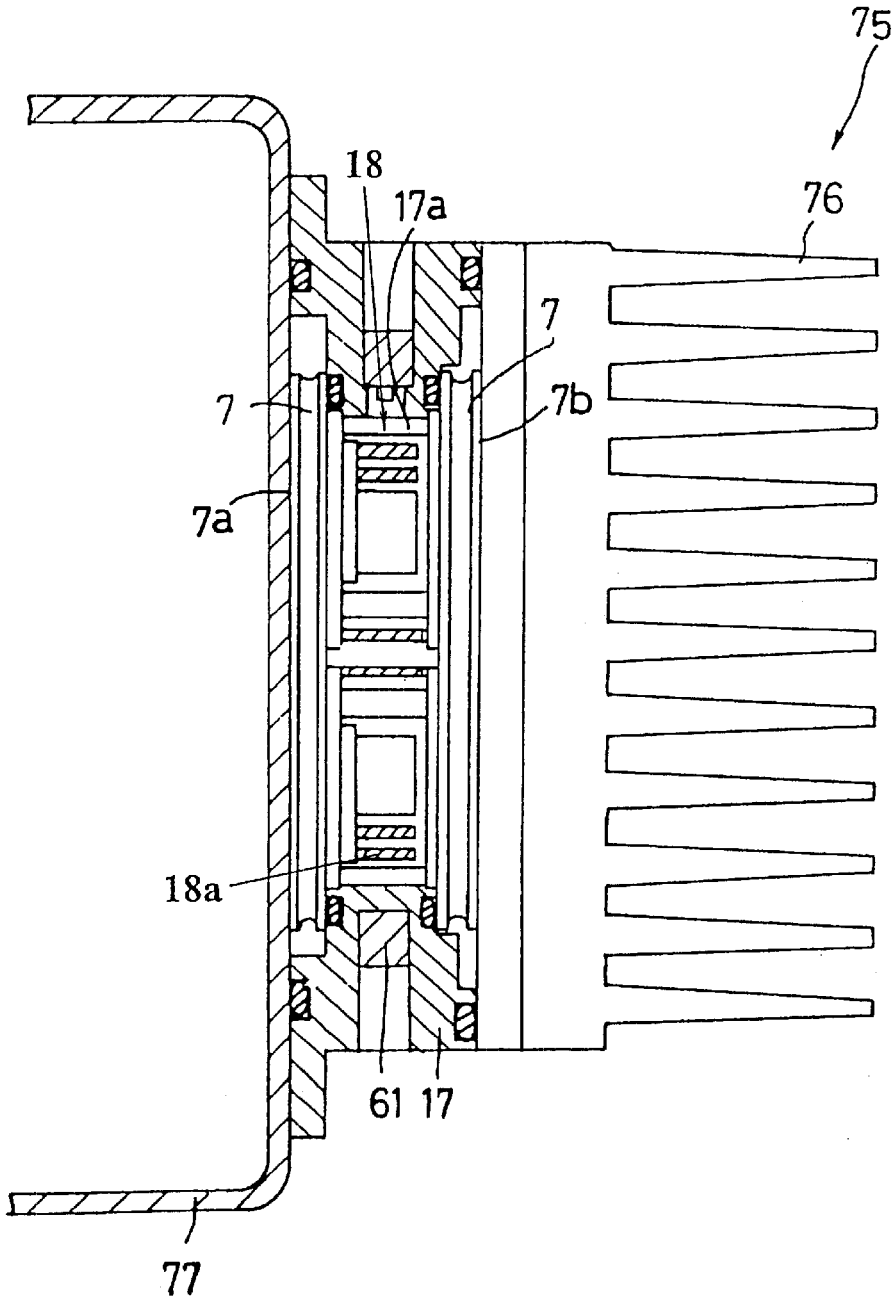
FIG. 29 is an overall longitudinal sectional view of the thermoelectric device according to a fourth embodiment of the present invention.

FIG. 29 illustrates the thermoelectric device 75 according to a fourth embodiment of the present invention. In this thermoelectric device 75, no manifold is employed and, instead, a radiating fin member 76 is provided at a heating side end portion of a cavity defining member 17 defining a heat transfer cavity between the two thermoelectric modules 7, and a box 77 defining a refrigerating compartment is provided at a cooling side end portion.

The radiating fin member 76 is held in direct contact with the exothermic surface 7*b* of the heating side thermoelectric module 7. Also, the refrigerating compartment defining box 77 is held in direct contact with the endothermic surface 7*a* of the cooling side thermoelectric module 7.

The thermoelectric refrigerating device 75 according to this embodiment employs no pump structure and no piping and can, therefore, be constructed as a small-size compact refrigerator that may be a portable refrigerator.

What is claimed is:

1. A thermoelectric device having a cooling end side and a heating end side, said thermoelectric device comprising:

a plurality of thermoelectric modules each having an endothermic surface capable of becoming cooled when an electric current is supplied and an exothermic surface capable of becoming heated when the electric current is supplied, said thermoelectric modules being juxtaposed with the endothermic surface of one of said thermoelectric modules being in face-to-face relation with the exothermic surface of an adjacent one of said thermoelectric modules;

a cavity defining member for defining a heat transfer cavity between adjacent thermoelectric modules, the heat transfer cavity being capable of containing therein a heat transfer medium; and an O-ring member mounted on said cavity defining member and held in engagement with a peripheral edge portion of one of said thermoelectric modules.

2. The thermoelectric device as claimed in claim 1, further comprising a cooling cavity defining member for defining a cooling cavity between said cooling cavity defining member and the endothermic surface of one of said thermoelectric modules located at said cooling end side, said cooling cavity defining member having a fluid intake port and a fluid discharge port defined therein.

3. The thermoelectric device as claimed in claim 1, further comprising a heating cavity defining member for defining a heating cavity between said heating cavity defining member and the exothermic surface of one of said thermoelectric modules located at said heating end side, said heating cavity defining member having a fluid intake port and a fluid discharge port defined therein.

4. The thermoelectric device as claimed in claim 1, further comprising a heat transfer medium contained within the heat transfer cavity, wherein said heat transfer medium comprises water as a principal fluid.

5. A thermoelectric manifold having a cooling end side and a heating end side, said thermoelectric manifold comprising:

a manifold body having an interior;

a plurality of thermoelectric modules each having an endothermic surface capable of becoming cooled when an electric current is supplied and an exothermic surface capable of becoming heated when the electric current is supplied, said thermoelectric modules being juxtaposed with the endothermic surface of one of said thermoelectric modules being in face-to-face relation with the exothermic surface of an adjacent one of said thermoelectric modules; and an O-ring member mounted on said cavity defining member and held in engagement with a peripheral edge portion of one of said thermoelectric modules, wherein said interior of said manifold body is divided into a cooling cavity that is adjacent to an endothermic surface of one of said thermoelectric modules that is located on said cooling end side, a heating cavity that is adjacent to an exothermic surface of another of said thermoelectric modules that is located on said heating end side, and a heat transfer cavity that is between two of said thermoelectric modules and that is between the cooling cavity and the heating cavity, and the heat transfer cavity is capable of containing therein a heat transfer medium.

6. The thermoelectric manifold as claimed in claim 5, further comprising:

a stirring member for stirring a heat transfer medium within the heat transfer cavity when the heat transfer cavity contains therein a heat transfer medium, said stirring member being disposed in the heat transfer cavity;

a support shaft rotatably supporting said stirring member; and an oscillation preventing member positioned within said manifold body, wherein said support shaft is supported by said oscillation preventing member.

7. The thermoelectric manifold as claimed in claim 5, further comprising a heat transfer medium contained within the heat transfer cavity, wherein said heat transfer medium comprises water as a principal fluid.

8. A thermoelectric device having a cooling end side and a heating end side, said thermoelectric device comprising:

a plurality of thermoelectric modules each having an endothermic surface capable of becoming cooled when an electric current is supplied and an exothermic surface capable of becoming heated when the electric current is supplied, said thermoelectric modules being juxtaposed with the endothermic surface of one of said thermoelectric modules being in face-to-face relation with the exothermic surface of an adjacent one of said thermoelectric modules;

a cavity defining member for defining a heat transfer cavity between adjacent thermoelectric modules, the heat transfer cavity being capable of containing therein a heat transfer medium;

an O-ring member mounted on said cavity defining member and held in engagement with a peripheral edge portion of one of said thermoelectric modules; and a stirring member for stirring a fluid within the heat transfer cavity when the heat transfer cavity contains therein a fluid.

9. The thermoelectric device as claimed in claim 8, wherein said stirring member comprises a stirring blade rotatably supported within the heat transfer cavity.

10. The thermoelectric device as claimed in claim 9, further comprising:

a rotor carried by said stirring blade; and a stator disposed within said cavity defining member at a location adjacent an outer periphery of said stirring blade, wherein said rotor and said stator constituting an electric motor.

11. The thermoelectric device as claimed in claim 10, further comprising:

a support shaft rotatably supporting said stirring blade; and an oscillation preventing member held in abutment with an inner surface of said cavity defining member, wherein said oscillation preventing member supports said support shaft.

12. The thermoelectric device as claimed in claim 9, further comprising:

a support shaft rotatably supporting said stirring blade; and an oscillation preventing member held in abutment with an inner surface of said cavity defining member, wherein said oscillation preventing member supports said support shaft.

13. The thermoelectric device as claimed in claim 8, further comprising an electric power source common to all of said thermoelectric modules for supplying the electric current thereto, wherein each of said thermoelectric modules comprises a Peltier element including an array of series connected P-type and N-type semiconductors, and wherein a number of series connected P-type and N-type semiconductors of each Peltier element is unique with respect to the other Peltier elements.

14. The thermoelectric device as claimed in claim 8, further comprising a heat transfer medium contained within the heat transfer cavity, wherein said heat transfer medium comprises water as a principal fluid.

15. A thermoelectric manifold having a cooling end side and a heating end side, said thermoelectric manifold comprising:

a manifold body having an interior;

a plurality of thermoelectric modules each having an endothermic surface capable of becoming cooled when an electric current is supplied and an exothermic surface capable of becoming heated when the electric current is supplied, said thermoelectric modules being juxtaposed with the endothermic surface of one of said thermoelectric modules being in face-to-face relation with the exothermic surface of an adjacent one of said thermoelectric modules;

an O-ring member mounted on said cavity defining member and held in engagement with a peripheral edge portion of one of said thermoelectric modules;

a cooling stirring member;

a heating stirring member; and a heat transfer stirring member;

wherein said interior of said manifold body is divided into a cooling cavity that is adjacent to an endothermic surface of one of said thermoelectric modules that is located on said cooling end side, a heating cavity that is adjacent to an exothermic surface of another of said thermoelectric modules that is located on said heating end side, and a heat transfer cavity that is between two of said thermoelectric modules and that is between the cooling cavity and the heating cavity, the heat transfer cavity is capable of containing therein a heat transfer medium, wherein said cooling stirring member is disposed in the cooling cavity for stirring a cooling fluid within the cooling cavity when the cooling cavity contains a cooling fluid therein, wherein said heating stirring member is disposed in the heating cavity for stirring a heating fluid within the heating cavity when the heating cavity contains a heating fluid therein, and wherein said heat transfer stirring member is disposed in the heat transfer cavity for stirring a heat transfer fluid within the heat transfer cavity when the heat transfer cavity contains a heat transfer fluid therein.

16. The thermoelectric manifold as claimed in claim 15, further comprising:

a cooling paramagnetic body secured to said cooling stirring member;

a heating paramagnetic body secured to said heating stirring member; and a heat transfer paramagnetic body secured to said heat transfer stirring member, wherein each of said thermoelectric modules are arranged such that the endothermic and the exothermic surfaces of each of said thermoelectric modules are parallel with respect to each other, wherein said cooling stirring member is rotationally supported within the manifold body for rotation about a first axis that is perpendicular to any one of the endothermic and exothermic surfaces, wherein said heating stirring member is rotationally supported within the manifold body for rotation about a second axis that is perpendicular to any one of the endothermic and exothermic surfaces, wherein said heat transfer stirring member is rotationally supported within the manifold body for rotation about a third axis that is perpendicular to any one of the endothermic and exothermic surfaces, and wherein said cooling stirring member, said heating stirring member and said heat transfer stirring member are operable to rotate in unison with each other.

17. The thermoelectric manifold as claimed in claim 16, further comprising:

a rotor carried by one of the group consisting of said cooling stirring member, said heating stirring member and said heat transfer stirring member; and a stator disposed within said manifold body, wherein said rotor and said stator constitute an electric motor.

18. The thermoelectric manifold as claimed in claim 17, further comprising:

a support shaft for rotatably supporting said heat transfer stirring member; and an oscillation preventing member positioned within said manifold body, wherein said oscillation preventing member supports said support shaft.

19. The thermoelectric manifold as claimed in claim 16, further comprising:

a stator disposed radially about said heat transfer stirring member; and a rotor comprising a paramagnetic body that is secured to said heat transfer stirring member, wherein said stator is cooperable with said paramagnetic body to drive said heat transfer stirring member.

20. The thermoelectric manifold as claimed in claim 19, further comprising:

a support shaft for rotatably supporting said heat transfer stirring member; and an oscillation preventing member disposed within said manifold body, wherein said oscillation preventing member supports said support shaft.

21. The thermoelectric device as claimed in claim 16, further comprising:

a support shaft rotatably supporting said stirring blade; and an oscillation preventing member held in abutment with an inner surface of said cavity defining member, wherein said oscillation preventing member supports said support shaft.

22. The thermoelectric manifold as claimed in claim 15, further comprising an electric power source common to all of said thermoelectric modules for supplying the electric current thereto, wherein each of said thermoelectric modules comprises a Peltier element including an array of series connected P-type and N-type semiconductors, and wherein a number of series connected P-type and N-type semiconductors of each Peltier element is unique with respect to the other Peltier elements.

23. The thermoelectric manifold as claimed in claim 15, further comprising a heat transfer medium contained within the heat transfer cavity, wherein said heat transfer medium comprises water as a principal fluid.

* * * * *

UNITED STATES PATENT AND TRADEMARK OFFICE

CERTIFICATE OF CORRECTION

PATENT NO. : 6,474,073 B1
DATED : November 5, 2002
INVENTOR(S) : Toshio Uetsuji et al.

It is certified that error appears in the above-identified patent and that said Letters Patent is hereby corrected as shown below:

Title page,
Item [75], change "Sakia" to -- Sakai --.
Item [86], change "Mar. 19, 1999" to -- Nov. 20, 2001 --.

Signed and Sealed this

Fifteenth Day of April, 2003

JAMES E. ROGAN
*Director of the United States Patent and Trademark Office*